US009441181B2

(12) United States Patent
Ivanov et al.

(10) Patent No.: US 9,441,181 B2
(45) Date of Patent: Sep. 13, 2016

(54) LUBRICANT AND SYNERGISTIC ADDITIVE FORMULATION

(75) Inventors: Michail Grigorievich Ivanov, Ekaterinburg (RU); Leonid Evgenievich Deev, Perm (RU); Olga Aleksandrova Shenderova, Raleigh, NC (US)

(73) Assignee: INTERNATIONAL TECHNOLOGY CENTER, Raleigh, NC (US)

( * ) Notice: Subject to any disclaimer, the term of this patent is extended or adjusted under 35 U.S.C. 154(b) by 286 days.

(21) Appl. No.: 13/386,221

(22) PCT Filed: Jul. 23, 2010

(86) PCT No.: PCT/US2010/043099

§ 371 (c)(1),
(2), (4) Date: Jan. 20, 2012

(87) PCT Pub. No.: WO2011/011714

PCT Pub. Date: Jan. 27, 2011

(65) Prior Publication Data

US 2012/0122743 A1 May 17, 2012

Related U.S. Application Data

(60) Provisional application No. 61/227,882, filed on Jul. 23, 2009.

(51) Int. Cl.
*C04B 35/52* (2006.01)
*C10M 133/56* (2006.01)
(Continued)

(52) U.S. Cl.
CPC ..... *C10M 141/04* (2013.01); *C10M 2201/041* (2013.01); *C10M 2201/066* (2013.01);
(Continued)

(58) Field of Classification Search
CPC ..... C10M 131/12; C10M 131/08
USPC ..... 508/109, 228, 315, 588
See application file for complete search history.

(56) References Cited

U.S. PATENT DOCUMENTS 3,062,741 A 11/1962 Crowl
4,501,676 A 2/1985 Moorhouse
(Continued)

FOREIGN PATENT DOCUMENTS

EP 1 953 214 A1 8/2008

OTHER PUBLICATIONS

Extended European Search Report issued Nov. 12, 2012 for corresponding European Application No. 10 80 2971.1.
International Search Report; Application No. PCT/US10/43099; Filing Date: Jul. 23, 2010.

*Primary Examiner* — Prem C Singh
*Assistant Examiner* — Francis C Campanell
(74) *Attorney, Agent, or Firm* — Miller Patent Services; Jerry A. Miller

(57) ABSTRACT

A friction modifying lubricant additive is provided comprising a base oil, colloidal nanocarbon particles, and a fluorine containing oligomeric dispersant. The fluorine containing oligomeric dispersant includes an anchoring group, a lipophilic hydrocarbon group, and a fluorinated oleophobic group. Further, a friction modifying lubricant additive is provided comprising a base oil, colloidal nanocarbon particles, a fluorine containing oligomeric dispersant, and at least one component selected from the group consisting of an antifriction component, an antiwear component, and an extreme pressure component. In another aspect, a method of manufacturing a lubricant additive is provided, the method comprising the step of mixing together a fluorine containing oligomeric dispersant, a dispersion of colloidal nanocarbon particles in a first base oil, and a second base oil.

25 Claims, 1 Drawing Sheet

(51) Int. Cl.

| | |
|---|---|
| ***C10M 173/00*** | (2006.01) |
| ***C10M 143/00*** | (2006.01) |
| ***C07C 15/24*** | (2006.01) |
| ***C10M 141/04*** | (2006.01) |

(52) U.S. Cl.

CPC ..... *C10M2205/0285* (2013.01); *C10M 2207/282* (2013.01); *C10M 2213/062* (2013.01); *C10M 2219/106* (2013.01); *C10M 2223/045* (2013.01); *C10N 2210/06* (2013.01); *C10N 2230/06* (2013.01)

(56) References Cited

U.S. PATENT DOCUMENTS

| | | | | |
|---|---|---|---|---|
| 5,039,438 | A | 8/1991 | Thermet et al. | |
| 5,066,412 | A * | 11/1991 | Migdal et al. | 508/496 |
| 5,578,387 | A | 11/1996 | Kai et al. | |
| 2003/0216266 | A1* | 11/2003 | Hirano et al. | 508/291 |
| 2004/0063589 | A1* | 4/2004 | Ramey et al. | 508/460 |
| 2006/0276355 | A1 | 12/2006 | Carey et al. | |
| 2007/0293405 | A1 | 12/2007 | Zhang et al. | |
| 2008/0127475 | A1 | 6/2008 | Griffo | |
| 2008/0248979 | A1* | 10/2008 | Nakagawa et al. | 508/128 |

* cited by examiner

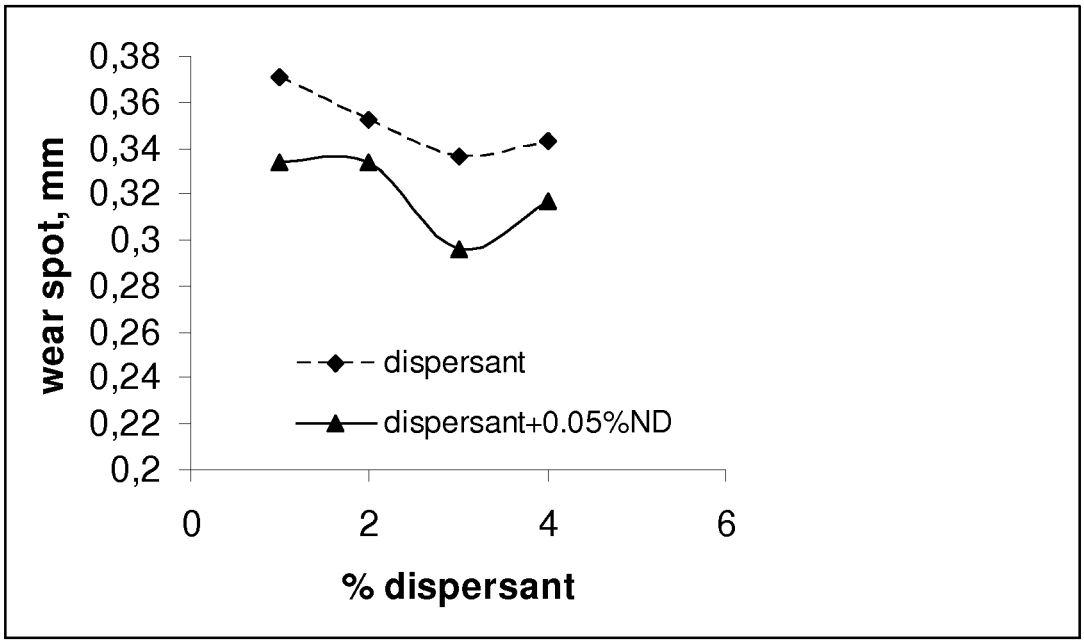
0,38
0,36
0,34
0,32
0,3
0,28
0,26
0,24
0,22
0,2
wear spot, mm
dispersant
dispersant+0.05%ND
0
2
4
6
% dispersant

LUBRICANT AND SYNERGISTIC ADDITIVE FORMULATION

CROSS REFERENCE TO RELATED APPLICATIONS

This is an application under 35 U.S.C. 371 from International Application No. PCT/US2010/043099 filed on Jul. 23, 2010, which claims priority to Provisional Application Ser. No. 61/227,882, filed on Jul. 23, 2009, the entire contents of which are incorporated herein by reference.

BACKGROUND OF THE INVENTION

1. Field of the Invention

The present invention relates generally to a friction modifying lubricant additive, and more particularly to lubricant additive including dispersed colloidal nanocarbon particles.

2. Description of the Related Art

A large reduction in friction coefficient and wear and improved extreme pressure failure load properties are demonstrated, which are particularly useful for lubricating oil compositions where the level of extreme pressure protection is needed in addition to low friction and wear.

Additives are used with lubricants in order to reduce friction and wear as well as to increase the load carrying capacity of the lubricants. The so called extreme pressure (EP) additives in lubricants are aimed for the lubricant's use under extreme pressure conditions, such as, for example, with the type of heavy equipment used for drilling, mining and other heavy industrial applications, for example, lubricants for open and enclosed gears, house roller and rails, and bearings. Organic compounds containing sulfur (S), phosphorus (P), chlorine (Cl), nitrogen (N), and boron (B), as well as organometallic compounds, especially, for example, zinc dialkyl dithiophosphates (ZDDP) and molybdenum dialkyldithiocarbamate (Mo-DTC) have been used widely as antiwear (AW) and/or EP additive components in lubricating oils.

Other additives that may be included in lubricants as anti-wear additives include fluorinated organic compounds, for example, polytetrafluorethylene (PTFE), which are thought to protect metal surfaces from wear by forming metal fluorides on the coated surfaces. One limitation of the highly fluorinated materials is their very low solubility in conventional lubricant base fluids such as natural and synthetic hydrocarbons and esters, which has effectively limited their application as solid additives Zinc dialkyl dithiophosphates with primary amines were shown to have better solubility in oils depending on the amine content. Partly-fluorinated compounds, particularly ZDDP, have better solubility in base oils and have been used as lubricant additives.

Fluorine-containing ZDDPs (F-ZDDPs) have also been used before in combination with certain molybdenum (Mo) additives, including soluble molybdenum additives, such as molybdenum dialkyl dithiophosphates, molybdenum dialkyl dithiocarbamates and molybdenum amide complexes. One limitation of F-ZDDP-Mo-containing additive combinations, however, is that the molybdenum additives frequently reduce the anti-wear effectiveness of the F-ZDDPs, which is highly undesirable.

Certain nanomaterials in powder and colloidal forms have been used as anti-friction and wear additives in a variety of base lubricants. Among them, detonation soot, which is a mixture of nanodiamond particles with different forms of $sp^2$-bonded carbon, has been used in commercial Class I oils for more than two decades. For a long time, it was assumed that pure detonation nanodiamond (DND), which is purified to remove $sp^2$ content as opposed to DND in the unpurified soot, was not suitable for lubrication, because of the abrasive nature of diamond particles. However, it was shown that, in combination with a dispersant, for example, 35 wt. % of magnesium (Mg) alcylobenzolesulphonate and 65 wt. % vegetable oil transesterificated with diethanolamine, and polytetrafluoroethylene (PTFE), the addition of DND results in decreased coefficient of friction in mineral oils of class I, as compared to a composition when only the dispersant and PTFE additives are used. (See Ivanov M. G., Kharlamov V. V., Buznik V. M., Ivanov D. M., Pavlushko S. G., Tsvetnikov A. K., Tribological properties of the grease containing polytetrafluorethylene and ultrafine diamond, Friction and Wear, 25 (1), 99 (2004)).

Dispersion of nanoparticles and other AW/EP additives in oils often required dispersants. The ash-less dispersants commonly used in the automotive industry contain a lipophilic hydrocarbon group and a polar functional hydrophilic group. The polar functional group can be of the class of carboxylate, ester, amine, amide, imine, imide, hydroxyl, ether, epoxide, phosphorus, ester carboxyl, anhydride, or nitrile. The lipophilic group can be oligomeric or polymeric in nature, usually from 70 to 200 carbon atoms to ensure oil solubility. Hydrocarbon polymers treated with various reagents to introduce polar functions include products prepared by treating polyolefins such as polyisobutene first with maleic anhydride, or phosphorus sulfide or chloride, or by thermal treatment, and then with reagents such as polyamine, amine, ethylene oxide, etc. Of these ashless dispersants the ones typically used in the petroleum industry include N-substitued polyisobutenyl succinimides and succinates, allkyl methacrylate-vinyl pyrrolidinone copolymers, alkyl methacrylate-dialkylaminoethyl methacrylate copolymers, alkylmethacrylate-polyethylene glycol methacrylate copolymers, polystearamides and other dispersants.

There have been various patents filed on lubricants containing detonation nanodiamonds. (See, e.g., E.P. Pat. 1,980,609, E.P. Pat. 1,953,214 and Rus. Pat. Nos. 2356938, 2054456). However, in order to achieve lubricants with not only low friction coefficient and antiwear properties, but also improved extreme pressure properties, the synergistic mechanisms provided by the addition of a combination of nanodiamonds and various additive components will be described herein.

SUMMARY OF THE INVENTION

The present invention provides a friction modifying lubricant additive including dispersed colloidal nanocarbon particles.

In one aspect, the present invention comprises a base oil, colloidal nanocarbon particles, and a fluorine containing oligomeric dispersant. The fluorine containing oligomeric dispersant includes an anchoring group, a lipophilic hydrocarbon group, and a fluorinated oleophobic group.

In another aspect, the present invention further provides a lubricant additive comprising a base oil, colloidal nanocarbon particles, a fluorine containing oligomeric dispersant, and at least one component selected from the group consisting of an antifriction component, an antiwear component, and an extreme pressure component.

Further, in another aspect, the present invention provides a method of manufacturing a lubricant additive, the method comprising the step of mixing together a fluorine containing oligomeric dispersant, a dispersion of colloidal nanocarbon particles in a first base oil, and a second base oil.

BRIEF DESCRIPTION OF THE DRAWINGS

These and other more detailed and specific features of the present invention are more fully disclosed in the following specification, reference being had to the accompanying drawings, in which:

FIG. 1 shows a wear spot tested in four-ball test as a function of fluorine-containing dispersant D1.21-diester of alkenylsuccinic anhydride and 1H,1H,13H-perfluorotridecane-1-ol and 1H,1H-perfluoroheptan-1-ol.

DETAILED DESCRIPTION OF THE INVENTION

According to an embodiment, diamond nano-particles (and/or OLC) are dispersed in a base oil using a fluorine containing dispersant so as to exert an effect in synergy with the complexes symmetrically fluorinated zinc dialkyl dithiophosphates with primary alkyl amines $H_2N(CH_2)_mCH_3$, where m=10-17 and/or oil-soluble molybdenum compounds. According to another embodiment, diamond nanoparticles (and/or OLC) are dispersed in a base oil using a fluorine containing dispersant so as to exert an effect in synergy with the PTFE additives. Synergy with other additives of NDs dispersed using a fluorine containing dispersant was also demonstrated.

Dispersants include at least three different types of functional groups: anchoring group, lipophilic hydrocarbon group and an oleophobic fluorinated segment. The anchoring groups (carboxyl group, esters and others) serve for anchoring of the dispersant on the surface of the DND particles by single-point or multi-point connections. The lipophilic hydrocarbon group is responsible for solubility in oils. An oleophobic fluorinated segment extended into an oil system provides steric stability, preventing DND agglomeration, therefore, the particles are stably dispersed. This group also reduces the surface tension at the DND-oil interface. Fluorosurfactants can lower the surface tension of water by a factor of two as compared to hydrocarbon surfactants. Due to the lipophobic nature of fluorocarbons, they tend to concentrate at the liquid-air interface. Due to the electronegativity of fluorine, the polarizability of the surfactants' fluorinated molecular surface is reduced, so that they are not as susceptible to the London dispersion force, which contributes to lipophilicity. Therefore, the attractive interactions are reduced, in comparison to hydrocarbon surfactants. Due to the stability of the carbon-fluorine bond, fluorosurfactants are more stable than hydrocarbon surfactants.

1. Base Oil

Mineral base stocks or synthetic base stocks, used in the lubricant industry, can be used as the base oil. More specifically, oils of Group I (solvent refined mineral oils), Group II (hydrocracked mineral oils), Group III (severely hydrocracked oils, sometimes described as synthetic or semi-synthetic oils), Group IV (polyalphaolefins (PAO)), and Group V (esters, naphthenes, and others). One preferred group includes the polyalphaolefins, synthetic esters, and polyalkylglycols. Other acceptable petroleum-based fluid compositions useful in the automotive industry include white mineral and paraffinic oils and naphthenic oil contaning N-vinylimidazole (NVI). Vegetable oils may also be utilized as the oil based liquid medium.

Examples and experiments described below were performed using different types of synthetic PAO oil and other classes of oils.

2. Nanodiamond and Onion-Like Carbon Additive

Detonation nanodiamonds (DND) are synthesized at the high pressure/high temperature conditions achieved within the shock wave resulting from the detonation of carbon-containing explosives with a negative oxygen balance. For most currently popular commercial DND products, the average primary particle size produced by this method is approximately 3-5 nm Primary nanodiamond particles produced by detonation of carbon containing explosives form both tightly bonded aggregates (possibly fused during the detonation process) and loosely bonded aggregates. Recently, using the stirred-media milling technique, it has been shown to be possible to de-agglomerate detonation nanodiamond and separate the primary particles with characteristic sizes of 4-5 nm. The experimental examples presented herein generally used selected agglomerates of detonation diamond nanoparticles, and the sizes presented are generally sizes of such nanoparticle agglomerates. The majority of examples below, though, use DND fractionated by ultracentrifugation into smaller and more narrow in size distribution fractions. Hence, the scope of the present invention is not limited to agglomerates of smaller primary particles, but also encompasses use of larger primary particles than those of the detonation nanodiamond (DND) used in the experiments. Polydispersed nanodiamond particles can be fractionated into fractions with different particle sizes with relatively narrow particle size distributions, with the size represented herein being measured using unimodal analysis of photon correlation spectroscopy data. From several DND samples, fractions of smaller particle sizes were produced for selected experiments.

Besides detonation nanodiamonds, nanodiamonds produced by other methods of dynamic or static synthesis can be used. Nanodiamonds of dynamic synthesis are nanodiamonds produced by using explosives. For example, nanodiamonds produced from a mixture of graphite and explosives can be used. Primary particle sizes of this type of ND are approximately 10-15 nm, as measured by the X-ray diffraction method. These primary particles form polycrystalline material which can be deagglomerated and ground to smaller size fractions (as small as 20-30 nm) and fractionated to fractions with narrow size distribution. Since these particles are polycrystalline, their density and friability is different from DND, and this can provide benefits in some applications where stronger particles are needed.

Diamond particles can be modified to enhance the stability of their dispersions in a suitable carrier or liquid, and provide chemical compatibility for oil. In addition, diamond and other carbon-based particulate mixtures with nanodiamonds may form complexes with organic molecules to enhance the reduction in friction coefficient, and wear and improve extreme pressure properties. A wide variety of surface groups is observed for the ND samples under study. The type of surface groups influences the dispersivity of DND in different solvents and materials as well as their resistivity to agglomeration and sedimentation. Surface groups of the nanodiamonds can be changed by known reactions in order to improve their dispersivity and resistance to agglomeration and sedimentation in different polar and non-polar media. Carboxylated, hydroxilated, aminated, fluorinated, hydrogenated, NDs with silane, acrylic groups, aliphatic chains and other functionalities were produced. Attachment of aliphatic chains was accomplished using standard organosilane coupling to the hydroxyl functionalized nanodiamond with a long-chain aliphatic reactive silane. The incorporation of polymerizable groups on the surface allows for bond formation between nanodiamond and many common polymer materials. The addition of a reactive vinyl group or reactive acrylate group was accomplished using standard organosilane coupling to the hydroxyl functionalized nanodiamond. An approach for ND functionalization using an atmospheric pressure plasma system that allows one to perform fluorination of ND particles within minutes was also developed. Treatment of DND in the flow of $F_2$ and $SF_4$ was also performed. The introduction of amine groups onto the surface allowed for facile coupling of materials which contain an acid functional group as well as coupling to materials containing a fluorinated surface. Depending on the types of surface groups, NDs can have positive or negative zeta potentials.

Onion-like carbon (OLC) is a carbon material formed in concentric multi-layered graphitic spheres. OLC is prepared by annealing the diamond nanoparticles (DND) in vacuum ($10^{-4}$ Pa) or an inert gas ambient at 1400° C. and 1800° C. Commercially available DND with an average diameter of primary particles 5-10 nm was used in the synthesis of the OLC. Similar to NDs, OLC can be also functionalized with different groups. For example, by treating OLC in an atmospheric plasma system in plasma discharge created in a fluorine-containing gas, for example, $CF_4$, fluorinated OLC were produced.

3. Antiwear/Extreme Pressure (AW/EP) Additive Components a. Complexes of Symmetrically Fluorinated Zinc Dialkyl Dithiophosphates with Primary Alkyl Amines A synergistic antiwear/extreme pressure (AW/EP) additive component used is based on the oil-soluble complex F-ZDDP·nR-$NH_2$ of symmetrically fluorinated zinc dialkyl dithiophosphates F-ZDDP with primary amines R-$NH_2$:F-ZDDP·n$H_2N(CH_2)_mCH_3$, where n=1-2, m=10-17.

Symmetrically fluorinated zinc dialkyl dithiophosphates (F-ZDDP) has formula (I), shown below:

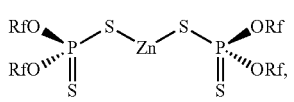

(I)

where Rf can be described by the general formula $X(CF_2CF_2)_nCH_2$—, where X=H, Cl, F; n=2-4.

Fluorinated zinc dialkyl dithiophosphates can be obtained in a reaction of polyfluorinated alcohols, for example, 1H,1H,5H-Octafluoropentan-1-ol or 1H,1H,7H-Perfluoroheptan-1-ol, anhydrous zinc acetate and phosphorous pentasulfide $P_2S_5$. Preparation of F-ZDDP is described in Example 3.1.

Compounds $\{[X(CF_2CF_2)_nCH_2O]_2P(S)S]\}_2Zn$, where X=Cl, F; n=2,3 can be obtained in a similar way.

In another embodiment, a formula for Rf may be: Cl—$(CF_2CF_2)_2CH_2$—.

Primary amines used for formulating complexes with F-ZDDP, R-$NH_2$ may have the formula (II), shown below:

$$H_2N(CH_2)_mCH_3 \quad \text{(II)},$$

where m=10-17.

Complex F-ZDDP·n$H_2N(CH_2)_mCH_3$, where n=1-2, m=10-17, was prepared by the addition to F-ZDDP of a certain amount of alkyl amine by constant stiffing at room temperature as described in Example 3: (m=10-12, as in Example 3.2) or at 60-80° C. (for m=15-17, as in Example 3.3) without additional purification.

Compositions of F-ZDDP·n$H_2N(CH_2)_mCH_3$ with m=10-13 (mixture), n=2 and with m=15-17, n=2 have been synthesized and the former one was tested in tribological tests.

It has been demonstrated that addition of primary aliphatic amines to non-fluorinated ZDDP resulted in degradation of antiwear properties, starting from a ratio ZDDP: $H_2N$-R=10:1 and higher. (See Fred G. Rounds, Some Effects of Amines on Zinc Dialkyldithiophosphate Antiwear Performance as Measured in 4-Ball Wear TestsTribology Transactions, 24:4,431-440, 1981). In the present case, addition of aliphatic amine $H_2N(CH_2)_mCH_3$: m=10-17 to F-ZDDP did not cause a noticeable increase of wear, but in the presence of nanodiamonds and acidic fluorine-containing ether dispersant provided solubility of symmetrically fluorinated zinc dialkyl dithiophosphates in oil and resulted in an unexpectedly high increase of extreme pressure failure load.

b. PTFE Components

Another useful fluorine-containing AW additive component is polytetrafluorethylene (PTFE). Examples of PTFE particles that can be added to oils (often in the presence of dispersants) include Zonyl MP 1100 (which is PTFE-COOH (COF)), typical PTFE (for example, MP 1600 and the like), and Dyneon 2025 (PTFE micropowder, modified with carboxylic acid groups, produced by electron or gamma irradiation of PTFE in the presence of oxygen). In the present case, Zonyl MP 1100 and PTFE with a trademark Forum, produced by epy company Vladforum, Vladivostok, Russia.

c. Oil-Soluble Molybdenum Compounds

Another AW/EP additive component used in a synergistic composition is oil-soluble molybdenum (Mo) compounds, where oil-soluble molybdenum compounds can be, for example, from the series of commercial products Molyvan 807 (a mixture of about 50 wt. % molybdenum, bis(C11-14 branched and linear alkyl) carbomodithioate oxo thioxo complexes, and about 50 wt. % of an aromatic oil, and containing about 4.6 wt. % molybdenum), Molyvan 855 (oil soluble secondary diarylamine, defined as substantially free of active phosphorus and active sulfur), Molyvan L (sulfonated oxymolybdenum dialkyldithiophosphate), Molyvan 2000, and others. Molyvan is produced by R. T. Vanderbilt company, Inc., New York, N.Y., USA. Also useful is SAKURA LUBE-500, which is a more soluble molybdenum (Mo) dithiocarbamate containing lubricant additive obtained from Asahi Denki Corporation. Other sources are molybdenum $Mo(CO)_6$, and Molybdenum octoate, MoO $(C_7H_{15}COO)_2$, containing about 8 wt. % molybdenum (Mo), marketed by Aldrich Chemical Company, Milwaukee, Wis., and molybdenum naphthenethioctoate, marketed by Shephard Chemical Company, Cincinnati, Ohio.

Another molybdenum compound useful in synergistic lubricants can be the vegetable oil modified organomolybdenum complex prepared by sequentially reacting fatty oil, diethanolamine and a molybdenum source by the condensation method described by Rowan et al. (See Rowan E, Karol T J, Fanner H H, Organic Molybdenum Complexes, U.S. Pat. No. 4,889,647 (1989)). The reaction yields a reaction product mixture and the major components of the vegetable oil modified organomolybdenum complex are believed to have structures (III.A) and (III.B), shown below:

(III.A)

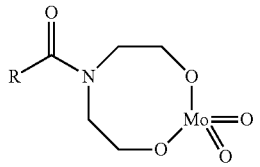

(III.B)

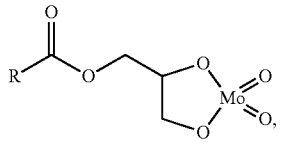

Tribological tests were performed for samples where dithiophosphate Mo and molybdenum, bis (C11-14 branched and linear alkyl) carbamodithioate oxo thioxo complexes were included in synergistic compositions.

4. Dispersant for Nanodiamond.

A dispersant for carbon particles to form colloidally stable compositions with oils typically contains a hydrophilic segment and a hydrophobic segment which surrounds the carbon particles thereby providing a means for isolating and dispersing the carbon particles. Preferred oil-based dispersants used a part of the synergistic composition were selected from classes of fluorine containing dispersants.

The fluorine containing oligomeric dispersant has isomeric structures (IV.A) and (IV.B), shown below:

(IV.A)

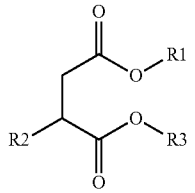

(IV.B)

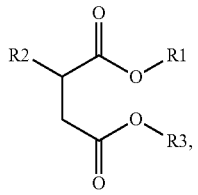

where R2 represents a saturated aliphatic hydrocarbon group, R1 are fluorine containing groups and R3 are parts of anchor groups or fluorine containing groups.

Reacting a perfluoroaliphatic alcohol with a polyalkenyl succinic acid anhydride in the presence of a catalyst (Ti $(OC_4H_9)_4$) allows one to obtain a fluorinated mono ((V.A) and/or diester (V.B) of an polyalkenylsuccinic acid of the formula (V.A)

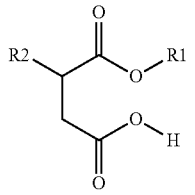

-continued (V.B)

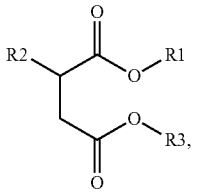

where R2 represents a saturated aliphatic hydrocarbon group having 15 to 60 carbon atoms, as shown below in formula (VI):

(VI)

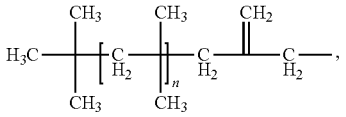

where n=15-60;

R1 and R3 are fluoroalkyl groups, or fluoroalkenyl groups having 4 to 50 carbon atoms, for example, the following Types (1.1), (1.2), (1.3) and (2):

Type (1.1): $H(CF_2CF_2)_nCH_2$—: n=2-6; Type (1.2): $F(CF_2CF_2)_nCH_2$—: n=2-6;

Type (1.3): $F_3CCFHCF_2CH_2$—;

Type (2): $F(CF_2CF_2)_nCH_2CH_2$—: n=1-10

In one embodiment, R3=H, and in another embodiment, R3=R1.

In another embodiment, the dispersant is a product of a reaction of tris-hydroxymethylaminomethane (THAM) and the fluorine containing oligomeric dispersant of structure (IV.A) and (IV.B), with R1=$F(CF_2CF_2)_3CH_2$—. Such fluorine containing oligomeric dispersant comprises a mixture of structures (VII.A) and (VII.B) of the following compositions:

(VII.A)

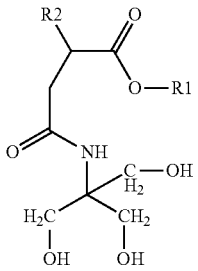

(VII.B)

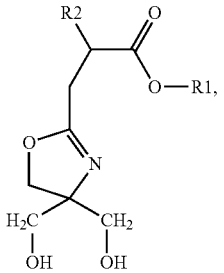

Unique features of the dispersants (V.A) and (V.B) include their ability to highly disperse nanodiamond and onion-like carbon particles as well as to serve the role of friction modifiers of the dispersants themselves.

In some of the examples below, chemical formulas are accompanied with product characteristics provided with the Russian Federation product reference numbers, generally of the form "TY-numbers/dashes".

The lubricant additive according to the formulas (IV.A) and (IV.B) is obtained by a reaction involving monoester or diester of alkyl- or alkenylsuccinic acid and one of the following polyfluorinated alcohols:

$H(CF_2CF_2)_nCH_2OH$: n=2-6 (polyfluorinated alcohol, TY 6-09-4830-80, available from the company OOO Galogen, Perm, Russia);

$F(CF_2CF_2)_nCH_2OH$: n=2-6 (polyfluorinated alcohol, available from OOO Galogen, Perm, Russia);

$F_3CCFHCF_2CH_2OH$ (polyfluorinated alcohol 2,2,3,4,4,4-Hexafluorobutan-1-ol, available from OOO Galogen, Perm, Russia: and $F(CF_2CF_2)_nCH_2CH_2OH$: n=1-10 (available from DuPont de Nemours and Co. of Wilmington, Del.).

The fluorine containing oligomeric dispersant according to the formulas (IV.A) and (IV.B) have the anchoring group including at least one of carboxylic acid groups, ketones, hydroxyl groups, and esters;

a lipophilic hydrocarbon group including at least one of saturated aliphatic hydrocarbon group (for example, polyisobutylene);

and fluorinated oleophobic segment including at least one of a fluoroalkyl group and a fluoroalkenyl group.

Dispersants used in various embodiments, examples, and experiments described herein are summarized in Table 1D.

TABLE 1D

Notations of various dispersants used and described herein in the experiments, examples, and compositions are shown in Table 1D.

| Notation | Composition |
|---|---|
| D1.11 | monoester of alkenylsuccinic anhydride and 1H,1H,13H-Perfluorotridecane-1-ol |
| D1.12 | monoester of alkenylsuccinic anhydride and 1H,1H-perfluoroheptan-1-ol |
| D1.21 | diester of alkenylsuccinic anhydride and 1H,1H,13H-perfluorotridecane-1-ol and 1H,1H-perfluoroheptan-1-ol |
| D1.22 | diester of alkenylsuccinic anhydride and 1H,1H-Perfluoroheptan-1-ol |
| D1.32 | diester of alkenylsuccinic anhydride and 2,2,3,4,4,4-Hexafluorobutan-1-ol |
| D1.41 | monoester of alkenylsuccinic anhydride and 1H,1H,5H-Perfluoropentan-1-ol |
| D1.51 | monoester of alkenylsuccinic anhydride and 1H,1H,7H-Perfluoroheptan-1-ol |
| D1.61 | monoester of alkenylsuccinic anhydride and 1H,1H,2H,2H-Perfluorodecane-1-ol |
| D2 | palm oil transesterificated with diethanolamine and polyfluorinated alcohol |
| D3 | palm oil transesterificated with diethanolamine |
| D4 | octadecylamine salt of perfluoroheptanoic acid |
| TT1, TT2 (Table III) | sulfurized dispersants |

EXAMPLES

Below are demonstrated and disclosed compositions and methods of preparation of different components of a lubricating composition, according to various examples of the present invention. However, the examples disclosed herein are given only as examples, and in now way should be construed as limiting the scope of the present invention.

There can be other methods of preparation of a synergistic lubricating composition. It is most practical to obtain oil additive formulations with up to 10 wt. % of ND, to be further added to the base oil before utilization, but other concentrations of ND in the additive can be used, as shown in the examples below.

Example 1

DND hydrosols were used as starting material for preparation of DND suspensions in a base oil. Compositions with up to 5 wt. % of nanodiamond (ND) in base oils in Example 1 were prepared as a concentrate to be added to a base PAO oil. First, a hydrosol of ND (3-8 wt. %) were mixed with an equal volume of 2-butoxyethanol. The mixture was homogenized using ultrasound for a period of 20-30 minutes. Then water was removed under vacuum using a rotor vapor. To the obtained suspension of DND in 2-butoxyethanol, an amount of a base PAO oil was added in the amount necessary to obtain 5 wt. % of DND in the final oil formulation. Then the mixture was homogenized using ultrasound for 20-30 minutes and 2-butoxyethanol was removed under vacuum using a rotor vapor. The final ND-oil suspension was additionally homogenized using ultrasound for 20-30 minutes. Ultrasonication can be done either in a bath-type ultrasonicator, or by a tip-type ultrasonicator. In Example 1, ultrasonication was done by a tip-type sonicator. Other approaches for suspension homogenization could be utilized.

Example 2

Example 2.1. Monoester of polyisobutenylsuccinic acid and polyfluorinated alcohol are used to demonstrate how a fluorine-containing dispersant of general formula (V.A) can be obtained. A mixture of 200 g of polyisobutenylsuccinic acid anhydride (with acidic number 54 mg KOH per 1 g and kinematic viscosity 130 $mm^2/C$ at 100° C. (TY 0257-014-33992933-2006, available from OOO Galogen, Penn, Russia) and 61 g 1H,1H,13H-Perfluorotridecane-1-ol (TY 6-09-4830-80), available from OOO Galogen, Penn, Russia) is heated to 130° C. Then the catalyst tetrabutoxytitane (1.0 g) is added and the mixture is stirred at 130° C. for 1-2 hours and then at 150-170° C. for 3-5 hours. Then the mixture is heated at 150° C./30 mmHg, and 260 g of a monoester of alkylsuccinic acid of general formula (V.A) is obtained. The resulting product (dispersant D1.11) is typically a waxy solid at room temperature, soluble in mineral and PAO oil.

Monoester of polyisobutenylsuccinic acid and polyfluorinated alcohol of general formula (V.A) with related fluorine containing groups of Types 1, 1.2, and 2 can be obtained by a method similar to that described in Example 2.1, and oligometric fluorine containing compositions of general formula (V.B) are used as dispersants for nanodiamond.

Example 2.2. Monoester of polyisobutenylsuccinic acid and polyfluorinated alcohol are used to demonstrate how a fluorine-containing dispersant of general formula (V.B) can be obtained. A mixture of 100 g of polyisobutenylsuccinic acid anhydride (with acidic number 54 mg KOH per 1 g and kinematic viscosity 130 $mm^2/C$ at 100° C. (TY 0257-014-33992933-2006, available from OOO Galogen, Penn, Russia) and 28 g 1H,1H,2H,2H-Perfluorodecane-1-ol ($F(CF_2CF_2)_8CH_2CH_2OH$) (with registry number CAS 678-39-7, available from Alpha Aesar, Ward Hill, Mass., USA) is heated to 85° C. Then the catalyst tetrabutoxytitane (10 drops) is added and the mixture is stirred at 130±5° C. for 4-5 hours. Then the mixture is heated at 130° C./30 mm Hg, and 125 g of a monoester of alkylsuccinic acid of general formula (V.A) is obtained. The resulting product (dispersant D1.61) is typically a waxy solid at room temperature, soluble in mineral and PAO oil.

Example 2.3. Diester of an alkyl- or alkenylsuccinic acid and polyfluorinated alcohol are used to demonstrate how a fluorine-containing dispersant of general formula (V.B) can be obtained. A mixture of 200 g of polyisobutenylsuccinic acid anhydride (with acidic number 54 mg KOH per 1 g and kinematic viscosity 130 $mm^2$/C at 100° C. and 30 g 1H,1H,13H-Perfluorotridecane-1-ol and 20 g 1H,1H,7H-Perfluoroheptan-1-ol is heated to 110° C. Then the catalyst tetrabutoxytitane (1.0 g) is added and the mixture is stirred at 110° C. for 1-2 hours and then at 120-130° C. for 4-6 hours. Then the mixture is heated at 150° C./30 mmHg, and 250 g of a diester of alkylsuccinic acid of general formula (V.B) is obtained. The resulting product (dispersant D1.21) is typically a waxy solid at room temperature, soluble in mineral and PAO oil.

Example 3

Example 3.1 describes how symmetrically fluorinated zinc dialkyl dithiophosphates (F-ZDDP) $\{[X(CF_2CF_2)_n CH_2O]_2P(S)S]\}_2Zn$ (where n=2, X=H) can be obtained.

1H,1H,5H-Octafluoropentan-1-ol (27.85 g, 0.12 mol) was added dropwise over a period of 1 h to a stirred slurry of $P_2S_5$ (6.60 g, 29 6 mmol) in toluene (150 $cm^3$) and the mixture was refluxed for 12 h under a rapid flow of $N_2$. The reaction mixture was then cooled to 25° C., after which 5.05 g of a solid, anhydrous zinc acetate (27.5 mmol) was added in a single portion. This mixture was refluxed at a temperature of 110° C. to 115° C. for approximately 3 hours. Removal of the solvent in vacuum resulted in a yield of 29.2 g of the product as an off-white viscous liquid of fluorinated zinc dialkyl dithiophosphate. This product may be additionally purified by centrifugation, distillation, fractional crystallization, filtration, extraction, or other standard methods known to those skilled in the art.

Compositions $\{[(CF_2CF_2)_nCH_2O_2P(S)S]\}_2Zn$, where X=Cl, F; n=2,3, can be obtained similar to the described method in Example 3.

The complex F-ZDDP·$nH_2N(CH_2)_mCH_3$, where n=1-2, m=10-17 was obtained by addition of a certain calculated amount of alkyl amine to F-ZDDP with constant stirring at room temperature for m=10-12 (Example 3.2) or at 60-80° C. for m=15-17(Example 3.3) without additional purification.

Example 4

Example 4 demonstrates preparation of a complete synergistic composition for lubricating applications. Lubricant composition is prepared in a vessel with a stirrer and heating mantle and heated to approximately 40° C. First, 96.6 parts per 100 of polyalphaolefin oil (PAO-2) produced by ExxonMobil (trade mark SpectraSyn) is added to the vessel. Then 1.0 part of fluorine-containing monoester of polyisobutenylsuccinic acid from Example 2.1 is added while stirring. Stirring is continued while heating to maintain the temperature between 70-80° C. until the dispersant is fully dissolved. This mixture, called 'synthetic materials', is the base stock material to which other additives are introduced. To 97.6 parts per 100 of the synthetic material, 0.8 parts of concentrate of DND (5 wt. %) (Example 1) is added. The mixture is homogenized using ultrasonic treatment for 20-30 minutes. Then, 1.1 parts of the composition F-ZDDP·$nH_2N(CH_2)_mCH_3$ (Example 3.2) is added as well as 0.5 parts of Molyvan 807 from R. T. Vanderbilt and Company. The mixture is additionally stirred for 30 minutes.

Results of tribological tests for the composition prepared in Example 4 are shown in Experiments V (Table V) as the sample 800-04. Table V also contain results of tests of the composition prepared in accordance with Example 4, but some of the components of the total composition are absent.

Example 5

Example 5 demonstrates preparation of a DND dispersion in base oils of classes II and III using DND concentrate in PAO oil with fluorine-containing dispersant prepared similar to the description of Example 4. DND base stock material was prepared in PAO-6 oil with 1 wt. % of 20 nm DND and 15 wt. % of D1.11 dispersant. The DND concentrate (with dispersant) had an amber color and was completely transparent. Four types of base oil of classes II and III (2×6 cSt and 6 and 8 cSt, correspondingly) were used in experiments: Chevron Neutral Oil 100R, Motiva Star 6, Yubase 6 and ULTRA S-8. Baseoils were heated to approximately 40° C. Then 10% by weight amount of the DND concentrate in PAO-6 oil (with dispersant) was added to the base oils, shaked and sonicated one minute. The final DND content in the oils of classes II and III was 0.1 wt. %. Resulting formulations of DND in the base oils of classes II and III were also completely transparent and stable at least for a week (time of observation).

Example 6

Example 6 demonstrates a straightforward preparation of DND dispersion in oils of classes II and III (without using PAO oil for DND dispersion). Four types of base oils of classes II and III (2×6 cSt and 6 and 8 cSt, correspondingly) were used in the experiments: Chevron Neutral Oil 100R, Motiva Star 6, Yubase 6 and ULTRA S-8. First, concentrates of 100 nm DND in the base oils without dispersant were prepared according to the description of Example 1(at 5 wt. % of DND). While initially stable, concentrates started slow sedimentation the next day (1 mm of clear oil at the top of the vessels appeared). In parallel, dispersions of the dispersant D1.11 in base oils of classes II and III were prepared according to the description of Example 5 for PAO oil (at 15 wt. % of the dispersant). Then the mixtures of DND concentrate and D1.11 dispersant were mixed at 40° C. in proportions resulting in 0.1 wt. % of DND in the base oils. Mixtures were sonicated for 10 minutes. Thus, colloidally stable dispersions of DND in base oils of classes II and III were prepared.

Example 7

Example 7 demonstrates preparation of a DND dispersion in oils of class V. Oils of class V Priolube 3970 and Priolube 3999 from Croda were used in the experiments. First, DND dispersion in base oils of class V using DND concentrate in PAO oil with fluorine-containing dispersant was prepared similar to the description of Example 5. Priolube oils were heated to approximately 40° C. Then 10% by weight amount of the 20 nm DND concentrate in PAO-6 oil (with dispersant) was added to the base oils, shaken and sonicated 1 minute. The final DND content in the Priolube oils was 0.1 wt. %. Resulting formulations of DND in the Priolube oils were also completely transparent and stable at least for a week (time of observation).

Straightforward preparation of DND dispersion in Priolube oils (without using PAO oil for DND dispersion) was also pursued. The procedure was similar to Example 6. Colloidally stable dispersions of DND in Priolube oils were prepared.

Example 8

In Example 8, polycrystalline ND produced from a mixture of graphite/hexogen (40 nm fraction size in deionized (DI) water) and ND of static synthesis produced by high pressure high temperature synthesis (20 nm particle size in DI water) were used. Nanodiamonds were introduced from DI water into 2-butoxyethanol and then into PAO oil according to Example 1 and into oils of classes II and III according to Example 6. After mixing with dispersant (according to Examples 4 and 6), stable colloidal suspensions of polycrystalline and HPHT static nanodiamonds were obtained in base oils of classes II, III and IV.

Example 9

In this example the commercial additive Molyvan-855 was added at a concentration of 1 wt. % to oils of classes II, III, IV and V with 20-30 nm 0.1 wt. % DND and 1.5 wt. % dispersant prepared according to the Examples 4, 5 and 7. Base oils with DND and dispersant were heated to approximately 40° C. Then 1% by weight amount of Molyvan-855 was added to the oils, shaken and sonicated 10 minutes. Colloidally stable dispersions were obtained, preserving their transparency.

In the experiments below, testing has been performed on PAO oil-based formulations using ring-on-ring (for friction coefficient measurement), shaft/bushing (for extreme pressure failure load) and four ball extreme pressure tests (extreme pressure failure load and diameter of the wear spot).

Test apparatus CMT-1 was used for the ring-on-ring tests with quenched steel rings IIIX-15: hardness HRc 52, flat friction surfaces with roughness $R_a$=0.38. External diameter of the tribo-couple is $D_{ext}$=0.076 m and an internal diameter $D_{int}$=0.070 m. The rotational velocity was 500, 1000 and 1500 rpm. Rings were pressed together by a spring with a force of 314 N and the moment of friction was measured at all three rotational velocities at a stabilized moment of friction. Based on measured moments of friction, friction coefficients were calculated. For every composition of the lubricant, an average coefficient of friction was calculated based on the results of three rotational velocities.

The diameter of the wear spot was measured using a standard four-ball technique, also known as the Russian standard ГОСТ 9490-75, similar to ASTM in the United States. Balls made from steel IIIX-15 with diameter 12.70 mm were used. The rotational velocity of the upper ball was 1460 rpm and the load was 196 N. Time of loading was 60 minutes. The diameter of the wear spot was measured as an average from the wear spots of three bottom balls. The diameter of every single spot was defined as the half-sum of the longest and shortest axis of the wear spot. EP failure mode in the four-ball test was defined at rotational velocity 1460 rpm and a load 490 N applied with time intervals of 10 seconds.

In the shaft/bushing tests, shafts (length 2.5 cm, diameter 3.62 cm) were made from un-quenched steel. Bush (length 30 cm, diameter 3.56 cm) was made from 17XH3A quenched steel. The rotational velocity was 300 rpm. The load was increased in increments of 50 kG until the failure load was reached.

EXPERIMENTS

Below are disclosed compositions and methods of preparation of different components of a lubricating composition, according to various series of experiments performed while developing the present invention. However, the description and disclosure of the below experiments are given only by way of example, and in now way should be construed as limiting the scope of the present invention.

Experiment I

In this series of experiments the tribological properties of PAO oil in combination with fluoro-dispersants, PTFE (Forum) and 150 nm ND particles were explored. Mixtures of PAO-6 as a base oil (supplied by the company OOO Tatneft-Neftekamsk neftehim-oil, Niznekamsk, Russia), DND possessing an average aggregate size of 150 nm when dispersed in water, PTFE particles (with average particle size of 0.1-2.0 microns (produced by the company Forum, Vladivostok, Russia) and different types of dispersants (Table I) were prepared. Stable colloidal dispersions of DND in PAO oil were formulated at DND loadings of 0.025 wt. %, 0.05%, 0.1% and 1%.

TABLE I

Tribological characteristics of formulations of PAO-6 and DND with different composition of dispersants and PTFE (Forum) additives.

| sample | DND, wt. % | PTFE, wt. % | Dispersant, wt. % (type) | Friction coef., ring-on-ring test | EP failure load in shaft/bushing test, kG | EP failure load in four ball test, kG | Diameter of wear spot, mm |
|---|---|---|---|---|---|---|---|
| PAO-6 | — | — | — | 0.106 | 163 | 150 | 0.567 |
| 774 | 1.0 | 1.2 | — | 0.056 | 300 | — | — |
| 775 | 0.1 | 0.12 | 1.67 (D1.11) | 0.065 | 250 | — | — |
| 776 | 0.05 | 0.06 | 0.83 (D1.11) | 0.058 | 175 | — | — |
| 777 | 0.025 | 0.03 | 0.5 (D1.11)) | 0.111 | 275 | — | — |
| 778 | 0.1 | — | 0.8 (D4) | 0.046 | — | 350 | 0.434 |
| 779 | 0.1 | 0.1 | 3.5 (D3) | 0.111 | — | 300 | 0.428 |

TABLE I-continued

Tribological characteristics of formulations of PAO-6 and DND with different composition of dispersants and PTFE (Forum) additives.

| sample | DND, wt. % | PTFE, wt. % | Dispersant, wt. % (type) | Friction coef., ring-on-ring test | EP failure load in shaft/bushing test, kG | EP failure load in four ball test, kG | Diameter of wear spot, mm |
|---|---|---|---|---|---|---|---|
| 780 | 0.1 | — | 3.5 (D2) | 0.038 | — | 400 | 0.317 |
| 789 | 0.1 | — | 1.0 (D1.11) | 0.038 | — | 150 | 0.306 |
| 791-A PAO-6 | — | — | 1.0 (D1.11) | — | — | 150 | |

In addition to the dispersant D1.11 described in Example 2.1, the following dispersants were also synthesized:

(D2): palm oil transesterificated with diethanolamine and polyfluorinated alcohol;

(D3): palm oil transesterificated with diethanolamine; and (D4): octadecylamine salt of perfluoroheptanoic acid.

Dispersants D3 and D2 demonstrate how addition of a fluorine containing group influences the ability of dispersants to disperse DND in PAO oil as well as their tribological performance. Dispersant D3 contains typical friction modifiers such as glycerides, which are esters of glycerol and fatty acids in which one or more of the hydroxyl groups of glycerol are esterified with the carboxyl groups of fatty acids. It also contains fatty acid amides. In order to improve dispersion of DND due to steric repulsion of fluorine-containing groups of the dispersant D3, in addition to transesterification of palm oil with diethanolamine, it was also transesterificated with polyfluorinated alcohol (dispersant D2). As a result, the dispersivity of DND using D2 as compared to D3 was improved, as well as tribological properties of the composition (Table I). The same effect was observed for the dispersant D4, octadecylamine salt of perfluoroheptanoic acid, after creation of fluorine-containing group.

Out of dispersants tested in Table I, the best dispersivity of DND in PAO oil was observed for the dispersant D1.11.

In the series 778, 780, 789 improvements in the tribological properties of the formulations are achieved by adding only DND (up to 0.1 wt. %) and dispersants. As compared to sample 791A (PAO-6 with pure dispersant D1.11), EP failure load increased several times after the addition of NDs (except sample 789 (0.1% of ND with dispersant D1.11)).

Experiment II

In this series of experiments the tribological properties of PAO oils in combination with fluorine-containing dispersants, PTFE (with trademark Zonyl, produced by DuPot, USA) and 150, 30 and 10 nm NDs were explored. Mixtures of PAO-6 as a base oil or PAO-6+ obtained from Exxon Mobil, DND possessing an average aggregate size of 150 nm, 30 nm or 10 nm (when dispersed in water), PTFE particles (Zonyl MP 1100 (PTFE-COOH (COF) with average particle size of 2.0-3.0 microns produced by DuPont, USA) and the dispersant D1.11 were prepared (Table II). NDs with average aggregate sizes of 150 nm and 10 nm have positive zeta potentials when dispersed in water (due to hydroxyl, ketone and ether groups on the surface), while the sample with 30 nm ND average aggregates size has negative zeta potential (due to carboxylic groups on the surface). Stable colloidal dispersions of DND in PAO oil had been formulated at DND loadings of up to 0.03 wt. %.

TABLE II

Tribological characteristics of formulations of PAO-6, PAO-6+ and DND with different composition of dispersants and PTFE (Zonyl MP 1100) additive components.

| sample | DND, wt. % | Dispersant, wt. % | AW/EP additive, wt. % | Friction coef., ring-on-ring test | EP failure load in four ball test, kG | Diameter of wear spot, mm |
|---|---|---|---|---|---|---|
| PAO-6 | — | — | — | 0.106 | 150 | 0.567 |
| 827 PAO-6 | 0.03 (150 nm) | 1.0 (D1.11) | 0.3 PTFE (Zonyl) | 0.052 | 550 | 0.341 |
| 829 PAO-6 | 0.03 (10 nm) | 1.0 (D1.11) | 0.3 PTFE (Zonyl) | 0.016 | 750 | 0.350 |
| 833-1 PAO-6 | — | 1.0 (D1.11) | 0.3 PTFE (Zonyl) | 0.051 | 750 | 0.303 |
| PAO-6 | — | 1.0 (D1.11) | — | | 150 | — |
| 773-1 PAO-6+ | — | 1.0 (D1.11) | — | 0.022 | 150 | 0.399 |
| PAO-6+ | — | — | — | 0.104 | 150 | 0.646 |
| 808-1 PAO-6+ | 0.025 (30 nm) | 1.0 (D1.11) | 0.3 PTFE (Zonyl) | 0.085 | 650 | 0.341 |

As it follows from Table I, after addition of DND, a dispersant from the group D1-D4 and PTFE particles, the coefficient of friction decreased (except using D3), diameter of wear spot decreased and EP failure load in shaft/bushing tests and four ball tests increased for most samples as compared to tests of the base oil.

As can be seen from Table II, EP failure load in the four ball tests is significantly increased for samples including the fluorine-containing dispersant, PTFE particles and ND (samples 827, 829, and 808-1). Wear spots are decreased as compared to pure oil. It should be also emphasized that EP failure load is higher and the friction coefficient is lower for the sample with smaller size of ND aggregates (829 versus 827 for PAO-6).

For a sample with D1.11 and PTFE without ND (833-1), EP failure load is similar, wear spot is insignificantly smaller, but addition of ND in sample 829, resulted in a decrease in the coefficient of friction by almost 3 times as compared to the sample 833-1.

Experiment III

In this series of experiments the tribological properties of PAO oils in combination with different types of fluoro-dispersants and EP/AW additive components with ND 150 nm average aggregate size were studied. Compositions including PAO-6 or PAO-2 as the base oil (supplied by the company OOO Tatneft-Niznekamsk neftehim-oil, Niznekamsk, Russia), DND possessing an average aggregate size of 150 nm (when dispersed in DI water), several types of anti-wear (AW)/extreme pressure (EP) additive components and different types of dispersants (or no dispersants) were prepared. Results are summarized in Table III. Stable colloidal dispersions of DND in PAO oil had been formulated at DND loadings up to 0.1%.

TABLE III

Tribological characteristics of formulations of PAO-6 or PAO-2 used as a base oil with DND and different composition of dispersants (or no dispersants) and AW/EP additive components.

| sample | DND, wt. % (150 nm) | Dispersant, wt. % | AW/EP additive, wt. % | Friction coef., ring-on-ring test | EP failure load in four ball test, kG | Diameter of wear spot, mm |
|---|---|---|---|---|---|---|
| PAO-6 | — | — | — | 0.106 | 150 | 0.567 |
| 796 (PAO-6) | 0.1 | 3.5 D2 | 1.0 (AA) | 0.047 | 150 | 0.427 |
| 797 (PAO-6) | 0.03 | 1.0 (D1.11) | 0.7 F-ZDDP + 0.5 R—$NH_2$ | 0.043 | 750 | 0.375 |
| 798 (PAO-6) | 0.03 | 1.0 TT1 | 1.0 (AA) | 0.039 | 150 | 0.392 |
| 984-1 PAO-6 | — | 1.5 (D1.61) | — | 0.055 | 150 | 0.376 |
| 984-2 PAO-6 | 0.05 | 1.5 (D1.61) | — | 0.054 | 150 | 0.378 |
| 985 PAO-6 | 0.05 | 1.0 (D1.61) | 6MΦK-180 | 0.043 | 150 | 0.278 |
| PAO-2 | — | — | — | 0.146 | 150 | 0.867 |
| 792 (PAO-2) | 0.1 | — | 1.0 (AA) | 0.087 | 150 | 0.676 |
| 795 (PAO-2) | 0.03 | 1.0 TT2 | 1.0 (AA) | 0.052 | 900 | 0.394 |
| 799 (PAO-2) | 0.03 | — | 1.7 F-ZDDP + 0.7 R—$NH_2$ | 0.051 | 550 | 0.411 |
| 817 (PAO-2) | 0.03 | 1.0 (D1.11) | 1.1- F-V871 + 0.6-Molyvan-L | 0.017 | 450 | 0.532 |

Where in Table III, AW/EP additive components are:

AA—alkenylsuccinic anhydride;

F-ZDDP (formula I): R=Cl—$(CF_2CF_2)_2CH_2$— in the R—$NH_2$: R=$C_{10}$-$C_{14}$;

TT—sulfurized dispersant (a product formed by heating (A) a mixture of a carboxylic acid ester and a fatty acid diethanol amine derivative selected from fatty acid amides, fatty acid esters, fatty acid ester-amides of diethanol amine, and mixtures thereof with (B) sulfur or a sulfur source at an elevated temperature at which sulfurization occurs). Since TT can be dispersed only in hot PAO, AA was used in combination with TT to improve TT solubility in PAO. For the TT2 notation (sample 795) the reaction of dispersing TT in the presence of AA took 1 hour at 150±5° C., while for the TT1 notation (sample 798) the reaction lasted 1 hour at 170±5° C.;

F-V871—composition based on Vanlube 871 transesterificated with polyfluorinated alcohol;

6MΦK-180(sample 985) is perfluoropolyether acid: $CF_3O[CF(CF_3)CF_2O]_nCF(CF_3)COOH$, where n=8-50 (known in Russia as a product with the tradename 6MΦK-180, it is a perfluoropolyether acid with reference number TY 2412-007-58949915-2004, available from the company Orgsintez, Dzerzinsk, Russia).

As can be seen from Table III, the combination of D1.11 and F-ZDDP+R—$NH_2$ (sample 797 in PAO-6 and sample 799 in PAO-2) provides significant improvements in all tribological characteristics. The combination of DND and (AA+1.0TT2) also provides very significant improvement in EP failure load (sample 795). It is very challenging to increase EP failure load for oils of low viscosity, like PAO-2 and the results are very surprising.

Experiment IV

In this series of experiments the tribological properties of PAO oils in combination with fluoro-dispers ant D1.11 and EP/AW additive components with ND of different average aggregate size and different zeta potentials were studied. Mixtures of PAO-6, PAO-6+ or PAO-2 as the base oil, DND possessing average aggregate size of 90 nm and 30 nm when dispersed in water, several types of anti-wear (AW)/extreme pressure (EP) additive components and different types of dispersants (Table IV) were prepared. PAO-6+ oil was obtained from Exxon-Mobil. ND with average aggregate sizes of 90 nm and 30 nm are obtained by centrifugal fractionation of polydispersed ND. Zeta potentials of 90 nm and 30 nm ND in water suspensions are negative. Stable colloidal dispersions of DND in PAO oil had been formulated at DND loadings of up to 0.1%. Formulations of ND with positive zeta potential and 10 nm aggregate size were also prepared and tested for comparison.

TABLE IV

Tribological characteristics of formulations of PAO-2, PAO-6 or PAO-6+ used as the base oil and DND with 10 nm (positive zeta potential), 20 and 30 nm (samples 7.2AB and 7.1AB with positive zeta potential) and 30 nm and 90 nm average aggregate size (and negative zeta potential) with dispersant D1.11 (1 wt. %) and AW/EP additive components (or no additives).

| sample | DND, wt. % | Dispersant | AW/EP additive, wt. % | Friction coef., ring-on-ring test | EP failure load in four ball test, kG | Diameter of wear spot, mm |
|---|---|---|---|---|---|---|
| PAO-2 | — | — | — | 0.146 | 150 | 0.867 |
| 800-04 (PAO-2) | 0.04 (90 nm) | 1.0 (D1.11) | 0.7 F-ZDDP + 0.4 R-$NH_2$ + 0.5 Molyvan_807 | 0.041 | 800 | 0.401 |
| 803 (PAO-6) | 0.03 (90 nm) | 1.0 (D1.11) | — | 0.043 | 150 | 0.399 |
| 884-1 (PAO-6) | 0.1 (10 nm) | 1.5 (D1.11) | — | 0.025 | 150 | 0.285 |
| 895 (PAO-6) | 0.05 (7.2AB) | 1.0 (D1.11) | — | 0.051 | 150 | 0.331 |
| 896 (PAO-6) | 0.05 (7.1AB) | 1.0 (D1.11) | — | 0.059 | 150 | 0.317 |
| PAO-6+ | — | — | — | 0.095 | 150 | 0.646 |
| 804-1 PAO-6+ | 0.05 (90 nm) | — | — | 0.088 | 150 | 0.688 |
| 804 (PAO-6+) | 0.05 (90 nm) | 1.0 (D1.11) | — | 0.038 | 150 | 0.324 |
| 805 (PAO-6+) | 0.1 (90 nm) | 1.0 (D1.11) | — | 0.051 | 150 | 0.350 |
| 806 (PAO-6+) | 0.05 (30 nm) | 1.0 (D1.11) | 0.4 R—$NH_2$ | 0.033 | 150 | 0.719 |
| 809 (PAO-6+) | 0.05 (30 nm) | 1.0 (D1.11) | 1.0 F-ZDDP•nR—$NH_2$ | 0.045 | 850 | 0.343 |
| 835 (PAO-6+) | 0.05 (30 nm) | 1.0 (D1.11) | 0.3 F-ZDDP•nR—$NH_2$ | 0.038 | 1000 | 0.324 |
| 807 (PAO-6+) | 0.1 (30 nm) | 1.0 (D1.11) | — | 0.017 | 150 | 0.338 |

Where Molyvan_807 is molybdenum, bis(C11-14 branched and linear alkyl) carbamodithioate oxo thiooxo complexes (50%).

In this series of experiments it is demonstrated that tribological characteristics of PAO-2 oil with 0.04 wt. % ND, D1.11 dispersant and (0.7 F-ZDDP+ 0.4 R—$NH_2$+0.5 Moly_807) additive (sample 800-04) is significantly improved. EP failure load in four ball test increased up to 800 kG (as compared to 150 kG in pure PAO-2 oil). For the sample with 0.05 wt. % of ND with 30 nm aggregate size, D1.11 dispersant and F-ZDDP-R–$NH_2$ additive, EP failure load in four ball tests increased up to 850 kG (sample 809) and 1000 kG (sample 835), as compared to 150 kG in pure PAO-6+ oil.

At the same time, the combination of NDs of 10 nm (positive zeta potential) and 30 nm and 90 nm (negative zeta potential) with only D1.11 dispersant did not result in an increase of EP failure load (samples 804,805,807,808, 808A, 808B), although the wear spot is noticeably decreased.

As can be seen for the sample 804-1, when only DND is introduced to PAO oil, friction coefficient is reduced very insignificantly, and wear spot is even increased. Example 4 demonstrates the importance of the fluoro-containing dispersants for good dispersivity of DND in oils and improvement of the oils tribological properties.

Experiment V

In another series of experiments, combinations of different dispersants and AW/EP additive components at different concentrations were prepared and tested (Table V). PAO-6 or PAO-6+ were used as a base oil.

TABLE V

Tribological characteristics of formulations of PAO-6 or PAO6+ used as the base oil with different composition of dispersants and AW/EP additive components. Samples 797 and 835 contain ND to demonstrate the synergistic effect.

| sample | DND, wt. % | Dispersant, wt. % | AW/EP additive, wt. % | Friction coef., ring-on-ring test | EP failure load in four ball test, kG | Diameter of wear spot, mm |
|---|---|---|---|---|---|---|
| PAO-6 | — | — | — | 0.106 | 150 | 0.579 |
| PAO-6-D | — | 1.0 (D1.11) | — | — | 150 | — |
| 832-1 PAO-6 | — | 1.0 D1.23 | — | 0.087 | 150 | 0.376 |
| 819 PAO-6 | — | 1.0 (D1.11) | 1.0(F-ZDDP•nR—$NH_2$) | 0.061 | 500 | 0.455 |
| 797 PAO-6 | 0.03 (150 nm) | 1.0 (D1.11) | 0.7 F-ZDDP + 0.5 R—$NH_2$ | 0.043 | 750 | 0.375 |

TABLE V-continued

Tribological characteristics of formulations of PAO-6 or PAO6+ used as the base oil with different composition of dispersants and AW/EP additive components. Samples 797 and 835 contain ND to demonstrate the synergistic effect.

| sample | DND, wt. % | Dispersant, wt. % | AW/EP additive, wt. % | Friction coef., ring-on-ring test | EP failure load in four ball test, kG | Diameter of wear spot, mm |
|---|---|---|---|---|---|---|
| 820-1 PAO-6 | — | 1.0 (D1.11) | 0.7(F-ZDDP•nR—$NH_2$) | 0.048 | 650 | 0.303 |
| 821 PAO-6 | — | 1.0 (D1.11) | 0.3(F-ZDDP•nR—$NH_2$) | 0.077 | 1000 | 0.268 |
| 822 PAO-6 | — | 1.0 (D1.11) | 0.6 F-ZDDP•nR—$NH_2$) + 0.3 Molyvan L | 0.046 | 300 | 0.299 |
| 823 PAO-6 | — | 1.0 (D1.11) | 0.6(F-ZDDP•nR—$NH_2$) + 0.6 Molyvan 807 | 0.062 | 730 | 0.261 |
| PAO-6+ | — | — | — | 0.095 | 150 | 0.646 |
| 818-1 PAO-6+ | — | 1.0 (D1.12) | — | 0.074 | 150 | 0.282 |
| 826 PAO-6+ | — | 1.0 (D1.21) | — | 0.036 | 150 | 0.364 |
| 834-1 PAO-6+ | — | 1.0 (D1.22) | — | 0.052 | 150 | 0.334 |
| 835 PAO-6+ | 0.05 (30 nm) | 1.0 (D1.11) | 0.3 F-ZDDP•nR—$NH_2$ | 0.038 | 1000 | 0.324 |

As can be seen from Table V, the combination of PAO oils with fluorine-containing dispersants can decrease the friction coefficient and wear spot as compared with pure oil, but does not increase EP failure load (samples 818-1, 826). Additive F-ZDDP.nR—$NH_2$ improves tribological properties of PAO oil significantly (samples 819, 820-1, 821). An especially large increase of EP failure load was observed for the sample with 0.3 wt. % of additive in the presence of fluorine-containing dispersant (sample 821). This load is the maximum load that can be measured on the 4-ball test apparatus used in this study, so in reality this value can be even higher for this sample.

From comparison of sample 819 (1.0% of F-ZDDP·nR—$NH_2$) and sample 797 (1.2% of F-ZDDP·nR—$NH_2$ and 0.03% of ND), the synergistic effect of a combination of ND, F-containing dispersant and F-ZDDP·nR—$NH_2$ can be demonstrated: tribological properties of the composition are noticeably better as compared to the properties of individual components added to the oil.

The combination of F-ZDDP·nR—$NH_2$ with Molyvan L and Molyvan 807 also improves the tribological properties of the oil (samples 822, 823).

For PAO-6+ oil excellent tribological characteristics are obtained for the synergistic composition of ND, dispersant D1.11 and 0.3% of F-ZDDP·nR—$NH_2$. As compared to sample 821 (no ND, and 0.3% of F-ZDDP·nR—$NH_2$ in PAO-6 oil), the coefficient of friction is two times lower.

The results of the tests also demonstrate the role of dispersant when only the dispersant is added to the oil (samples D1.11, D1.12, D1.22). For dispersants mono- and diesters (samples D1.11) based on high molecular weight polyfluorinated alcohol (approximately C13) with terminal hydrogen, the coefficient of friction is lower, but the wear diameter is larger. For perfluorinated alcohol (C6) with terminal fluorine, the coefficient of friction is larger, but the wear spot is lower (sample D1.12, D1.22). For the mixture of the two, the result is intermediate (sample D1.21).

Experiment VI

Mixtures of PAO-6 or PAO-6+ as the base oil with onion-like carbon obtained by annealing of ND at 1400K (OLC-1400) and 1800K (OLC-1800) using a fluorine-containing dispersant were prepared. OLC-1400 contains residual ND cores inside $sp^2$ shells. In another experiment, a mixture of OLC and DND using fluorine-containing dispersant were formulated and tested (sample 825). Sample with addition of detonation soot (977) into PAO oil in the presence of D1.11 dispersant was also tested for a comparison.

TABLE VI

Tribological characteristics of formulations of PAO-6 or PAO-6+ used as a base oil and OLC or OLC and DND as well as detonation soot with a dispersant.

| sample | DND, wt. % | Dispersant, wt. % | AW/EP additive, wt. % | Friction coef., ring-on-ring test | EP failure load in four ball test, kG | Diameter of wear spot, mm |
|---|---|---|---|---|---|---|
| PAO-6 | — | — | — | 0.106 | 150 | 0.579 |
| 825 PAO-6 | 0.05 (150 nm) | 1.0 (D1.11) | ≤0.05 OLC-1400 | 0.065 | 150 | 0.371 |
| PAO-6+ | — | — | — | 0.095 | 150 | 0.646 |
| PAO-6+ | 0.05 (90 nm) | — | — | 0.088 | 150 | 0.688 |
| 773-1 PAO-6+ | — | 1.0 (D1.11) | — | 0.022 | 150 | 0.399 |
| 815 (PAO-6+) | — | 1.0 (D1.11) | 0.1 (OLC-1400) | 0.042 | 150 | 0.301 |

TABLE VI-continued

Tribological characteristics of formulations of PAO-6 or PAO-6+ used as a base oil and OLC or OLC and DND as well as detonation soot with a dispersant.

| sample | DND, wt. % | Dispersant, wt. % | AW/EP additive, wt. % | Friction coef., ring-on-ring test | EP failure load in four ball test, kG | Diameter of wear spot, mm |
|---|---|---|---|---|---|---|
| 816 (PAO-6+) | — | 1.0 (D1.11) | 0.1 (OLC-1800) | 0.041 | 150 | 0.313 |
| 977 PAO-6 | — | 1.0 (D1.11) | 0.1 soot | 0.052 | 150 | 0.334 |

As can be seen from Table VI, the combination of OLC or OLC with ND in the presence of a fluorine -containing dispersant helps to decrease the wear spot as compared to pure oil or a mixture of oils with fluorine-containing dispersant. Tribological performance of detonation soot added to PAO oil using fluorine-containing dispersant has also satisfactory tribological properties.

Experiment VII

Mixtures were prepared of PAO-6 as the base oil, fluorinated DND possessing average aggregate sizes of 150 nm when dispersed in water, and the dispersant D1.11. Combinations of fluorinated DND with fluorine-containing dispersant in PAO with hexagonal boron nitride h-BN particles (with average particle size approximately 250-500 nm) were also prepared. Particles of h-BN as an AW/EP additive component are currently used for lubrication. Results are summarized in Table VII.

TABLE VII

Tribological characteristics of formulations of PAO-6 used as the base oil with a fluoro-containing dispersant and DND with fluorine-containing functional groups on the DND surface.

| sample | DND, wt. % | Dispersant wt. % | AW/EP additive, wt. % | Friction coef., ring-on-ring test | EP failure load in four ball test, kG | Diameter of wear spot, mm |
|---|---|---|---|---|---|---|
| PAO-6 | — | — | — | 0.106 | 150 | 0.579 |
| PAO-6-D | — | 1.0 (D1.11) | — | — | 150 | — |
| 828 PAO-6 | 0.02 (150 nm) (F = 8%) | 1.0 (D1.11) | — | 0.056 | 150 | 0.278 |
| 973 PAO-6 | 0.05 (150 nm) (F = 8%) | 1.5 (D1.11) | — | 0.055 | 150 | 0.252 |
| 987 PAO-6 | 0.05 (150 nm) F—ND($SF_4$) | 1.0 (D1.11) | — | 0.026 | 150 | 0.275 |
| 974 PAO-6 | 0.05 (150 nm) (F = 8%) | 1.5 (D1.11) | 0.75 h-BN | 0.042 | 500 | 0.298 |
| 972 PAO-6 | — | 1.5 (D1.11) | 0.75 h-BN | 0.065 | 600 | 0.355 |
| 988 PAO-6 | 0.05 (150 nm) ND-COOH | 1.0 (D1.11) | — | 0.046 | 150 | 0.285 |

DND with F=8% was obtained by treatment of ND in $F_2$ flow, while F-ND($SF_4$) was obtained by treatment in $SF_4$ flow, which provide more mild conditions for functionalization (only —OH and —COOH groups are substituted by fluorine on DND surface). For a comparison, carboxylated DND (ND-COOH), obtained by oxidation in air (at 420° C.) is also tested (sample 988).

As can be seen from Table VII, fluorine-containing NDs (fluorine as a part of its surface groups), decrease the diameter of the wear spot and friction coefficient as compared to the pure oil. The very good combination of low friction coefficient and reduced wear spot demonstrates DND with 0.05 wt. % of F-ND($SF_4$) (sample 987). Carboxylated DND dispersed in PAO using fluorine-containing dispersant also demonstrates relatively good tribological properties.

Other surface functionalization such as, for example, amination (to create links to dispersants) or hydrogenation, hydroxylation, silanation, attachment of acrylic, aliphatic chains and other functionalities on the samples can also be useful for improvement of tribological properties of NDs dispersed in oils.

Combination of DND and h-BN dispersed in PAO oil using fluoro-containing dispersant provides reasonably good combination of reduced friction coefficient and wear spot and increased EP to failure.

Experiment VIII

In the series of experiments of Experiment VIII, the synergistic effect o DND in combination with molybdenum-containing complexes and PTFE were tested. Mixtures were prepared of PAO-6 as the base oil, DND with 150 nm (positive zeta potential), and 30 nm and 90 nm average aggregate size (and negative zeta potential) with dispersants D1.11 and D1.21 and AW\EP additives Molyvan, Vanlube, $MoS_2$ (inorganic fullerene) and Molyvan/PTFE.

TABLE VIII

Tribological characteristics of formulations of PAO-6 used as the base oil with a fluoro-containing dispersants, DND and molybdenum-related AW/EP additive components.

| sample | DND, wt. % | Dispersant, wt. % | AW/EP additive, wt. % | Friction coef., ring-on-ring test | EP failure load in four ball test, kG | Diameter of wear spot, mm |
|---|---|---|---|---|---|---|
| 840-1 PAO-6 | 0.05 (150 nm) | 1.8 (D1.21) | 0.5 Molyvan L | 0.056 | 650 | 0.341 |
| 855 PAO-6 | — | 1.75 (D1.21) | 0.5 Molyvan L | 0.051 | 550 | 0.306 |
| 916 PAO-6 | 0.05 (150 nm) | 1.5 (D1.21) | 0.5 $MoS_2$ 0.5 Molyvan L | 0.051 | 550 | 0.352 |
| 874 PAO-6 | 0.05 (150 nm) | 1.75 (D1.21) | 0.5 Molyvan 2000 | 0.048 | 150 | 0.315 |
| 879 PAO-6 | 0.05 (30 nm) | 1.5 (D1.21) | 0.5 Molyvan 2000 | 0.029 | 150 | 0.299 |
| 875 PAO-6 | 0.05 (150 nm) | 1.75 (D1.21) | 0.5 Molyvan 807 | 0.059 | 150 | 0.324 |
| 841-1 PAO-6 | 0.05 (150 nm) | 1.75 (D1.21) | 0.28 PTFE 0.27 Molyvan L | 0.051 | 1000 | 0.315 |
| 856 PAO-6 | — | 1.75 (D1.21) | 0.28 PTFE 0.27 Molyvan L | 0.054 | 950 | 0.301 |
| 876 PAO-6 | 0.05 (150 nm) | 1.75 (D1.21) | 0.5 PTFE 0.5 Molyvan 2000 | 0.059 | 950 | 0.338 |
| 877 PAO-6 | 0.05 (150 nm) | 1.75 (D1.21) | 0.25 PTFE 0.25 Molyvan 2000 | 0.042 | 500 | 0.352 |
| 878 PAO-6 | 0.05 (150 nm) | 1.75 (D1.21) | 0.25 PTFE 0.25 Molyvan 807 | 0.043 | 1000 | 0.350 |
| 886 PAO-6 | — | 1.0 (D1.11) | 0.5 Vanlube-871 | 0.032 | 250 | 0.667 |
| 885 PAO-6 | 0.05 (90 nm) | 1.0 (D1.11) | 0.5 Vanlube-871 | 0.041 | 250 | 0.581 |

Commercially available lubricant additives provided by R. T. Vanderbilt company, Inc., New York, N.Y., USA under trademark VANLUBE <<871>>(2,5-dimercapto-1,3,4-thiadiazole, alkylpolycarboxylates) and Molyvan were used in a series of experiments.

As can be seen from Table VIII, combinations of DND, fluoro-containing dispersants and molybdenum-containing complexes and structures as well as addition of PTFE provide good combinations of lowered friction coefficient and wear spot and for some combinations—significant increase of EP failure load (up to 1000 kG, as defined from 4-ball wear test).

Experiment IX

In this series of experiments, role of dispersant concentration was explored in more details. Mixtures of the dispersant D1.21 varying between 1 and 4 wt. % were prepared of PAO-6 as the base oil. Then, formulations with same concentration of DND with average aggregate size 150 nm were prepared and tested.

TABLE IX

Tribological characteristics of formulations of PAO-6 used as the base oil with a fluorine-containing dispersant of different concentrations as well as oil-dispersant-0.05 wt. % of DND formulations.

| sample | DND, wt. % | Dispersant (D1.21), wt. % | Friction coef., ring-on-ring test | EP failure load in four ball test, kG | Diameter of wear spot, mm |
|---|---|---|---|---|---|
| PAO-6 | — | — | 0.106 | 150 | 0.579 |
| 842-1 PAO-6 | — | 1.0 | 0.056 | 150 | 0.371 |
| 842-2 PAO-6 | — | 2.0 | 0.038 | 150 | 0.352 |

TABLE IX-continued

Tribological characteristics of formulations of PAO-6 used as the base oil with a fluorine-containing dispersant of different concentrations as well as oil-dispersant-0.05 wt. % of DND formulations.

| sample | DND, wt. % | Dispersant (D1.21), wt. % | Friction coef., ring-on-ring test | EP failure load in four ball test, kG | Diameter of wear spot, mm |
|---|---|---|---|---|---|
| 842-3 PAO-6 | — | 3.0 | 0.054 | 150 | 0.336 |
| 842-4 PAO-6 | — | 4.0 | 0.038 | 150 | 0.343 |
| 843 PAO-6 | 0.05 (150 nm) | 1.0 | 0.033 | 150 | 0.334 |
| 844 PAO-6 | 0.05 (150 nm) | 2.0 | 0.049 | 150 | 0.334 |
| 845 PAO-6 | 0.05 (150 nm) | 3.0 | 0.045 | 150 | 0.296 |
| 846 PAO-6 | 0.05 (150 nm) | 4.0 | 0.036 | 150 | 0.317 |

For all concentration of the dispersant D1.21 in PAO oil, improvements in tribological properties are seen. FIG. 1 shows a wear spot tested in 4-ball test as a function of fluorine-containing dispersant (D1.21) concentration. Results are shown for pure dispersant in PAO-6 oil, as well as with 0.05 wt. % of DND addition.

As shown in FIG. 1, decrease of coefficient of friction and wear spot as compared to these characteristics for pure PAO oil show- non-linearity. Further, with addition of DND, the wear spot is further decreased. Coefficient of friction (COF) after addition of DND is also decreased as compared to formulation with pure dispersant (except data at concentration of the dispersant 2 wt. %, where after addition of DND COF is increased). These data demonstrate that the fluorine containing oligomeric dispersant posses the property of an antifriction and antiwear additive reducing the coefficient of friction and wear of the base oil. Optimal concentration of a dispersant can be obtained by running tribology tests at different dispersant concentrations at different concentrations of DND.

Experiment X

In the series of experiments of Experiment X, the role of the type of fluorine-containing dispersants was explored in more detail.

TABLE X

Tribological characteristics of formulations of PAO-6 used as the base oil with a fluorine-containing dispersant of different types.

| sample | Dispersant, 1 wt. % (type) | Friction coef., ring-on-ring test | EP failure load in four ball test, kG | Diameter of wear spot, mm |
|---|---|---|---|---|
| PAO-6 | — | 0.106 | 150 | 0.579 |
| 849-1 | (D1.11) | 0.043 | 150 | 0.320 |
| 850-1.1 | (D1.22) | 0.045 | 150 | 0.257 |
| 851-1.2 | (D1.32) | 0.045 | 150 | 0.273 |

TABLE X-continued

Tribological characteristics of formulations of PAO-6 used as the base oil with a fluorine-containing dispersant of different types.

| sample | Dispersant, 1 wt. % (type) | Friction coef., ring-on-ring test | EP failure load in four ball test, kG | Diameter of wear spot, mm |
|---|---|---|---|---|
| 853-1 | (D1.41) | 0.054 | 150 | 0.266 |
| 852-1 | (D1.51) | 0.061 | 150 | 0.254 |

As can be seen from Table X, all dispersants listed in Table X provide good improvements of the tribological properties of PAO oil. These data demonstrate that the fluorine containing oligomeric dispersants posses the property of an antifriction and antiwear additive reducing the coefficient of friction and wear of the base oil.

Experiment XI

In this series of experiments PAO-based additives with DND, fluorine-containing dispersant and other AW/EP additive components were added to formulated motor oils and tested.

TABLE XI

Tribological characteristics of formulated commercial oils with AW/EP additive components.

| sample | DND, wt. % | Dispersant, wt. % | AW/EP additive, wt. % | Friction coef., ring-on-ring test 500 rpm | 1000 rpm | 1500 rpm | Average | Diameter of wear spot, mm |
|---|---|---|---|---|---|---|---|---|
| Ashland oil | — | — | — | 0.052 | 0.048 | 0.048 | 0.049 | 0.292 |
| Ashland oil 897 | 0.05 (30 nm, Z−) | 1.5 (D1.21) | 0.6 Molyvan 2000 | 0.039 | 0.030 | 0.035 | 0.035 | 0.247 |
| Ashland oil 898 | 0.05 (30 nm, Z−) | 1.5 (D1.21) | — | 0.056 | 0.048 | 0.048 | 0.051 | 0.259 |
| Ashland oil 899 | 0.05 (150 nm) | 1.5 (D1.21) | — | 0.039 | 0.043 | 0.048 | 0.043 | 0.261 |
| Ashland oil 900-1 | 0.025 (100 nm) | 1.5 (D1.21) | — | 0.039 | 0.030 | 0.026 | 0.032 | 0.271 |
| Ashland oil 900-2 | 0.025 (100 nm) | 1.5 (D1.21) | 0.5 Molyvan L | 0.039 | 0.030 | 0.043 | 0.038 | 0.273 |
| Mineral, SAE: 15W40 API: CF/CC No 939 | — | — | — | 0.074 | 0.056 | 0.069 | 0.067 | 0.301 |
| Mineral, SAE: 15W40 API: CF/CC No 941 | 0.05 (30 nm, Z−) | 1.5 (D1.21) | — | 0.043 | 0.052 | 0.039 | 0.045 | 0.364 |
| Mineral, SAE: 15W40 API: CF/CC No 940 | 0.05 (30 nm, Z−) | 1.5 (D1.21) | 0.5 Molyvan L | 0.030 | 0.043 | 0.039 | 0.038 | 0.261 |
| Mineral, SAE: 15W40 API: CF/CC Semi Synthetic SAE: 5W30 API: CL No 948 | 0.05 (30 nm, Z−) | 1.5 (D1.21) | 0.63 Molyvan 2000 | 0.043 | 0.052 | 0.039 | 0.045 | 0.257 |
| Semi Synthetic SAE: 5W30 API: CL No 949 | — | — | — | 0.035 | 0.030 | 0.043 | 0.036 | 0.273 |
| Semi Synthetic SAE: 5W30 API: CL | 0.11 (90 nm, Z−) | 1.75 (D1.21) | 0.5 Molyvan L | 0.035 | 0.026 | 0.043 | 0.035 | 0.296 |
| | 0.06 (90 nm, Z−) | 1.0 (D1.21) | 0.28 Molyvan L | 0.048 | 0.035 | 0.043 | 0.042 | 0.264 |

TABLE XI-continued

Tribological characteristics of formulated commercial oils with AW/EP additive components.

| sample | DND, wt. % | Dispersant, wt. % | AW/EP additive, wt. % | Friction coef., ring-on-ring test 500 rpm | 1000 rpm | 1500 rpm | Average | Diameter of wear spot, mm |
|---|---|---|---|---|---|---|---|---|
| No 951 Semi Synthetic SAE: 5W30 API: CL | 0.05 (30 nm, Z−) | 1.5 (D1.21) | — | 0.065 | 0.065 | 0.061 | 0.064 | 0.357 |
| No 954 Semi Synthetic SAE: 5W30 API: CL | 0.05 (Z−) ≤100 nm | 1.5 (D1.21) | — | 0.052 | 0.043 | 0.034 | 0.043 | 0.278 |
| No 952 Semi Synthetic SAE: 5W30 API: CL | 0.025 (150 nm) | 0.75 (D1.21) | 0.53 Molyvan 2000 3.2 KL135 | 0.056 | 0.043 | 0.039 | 0.046 | 0.271 |
| No 953 Semi Synthetic SAE: 5W30 API: CL | 0.05 (10 nm, Z−) | 1.0 (D1.21) | 0.5 Molyvan L 0.35 MP1100 | 0.048 | 0.035 | 0.035 | 0.039 | 0.266 |
| Semi Synthetic SAE: 5W30 API: CL | — | — | 6.5 Cera Tec with h-BN | 0.052 | 0.043 | 0.052 | 0.049 | 0.266 |

Concentrations of DND, fluorine-containing dispersant and other AW/EP additive components are shown for the additive formulation. These additives are mixed with commercial oils at ratios approximately 1:20.

As can be seen from Table XI, at certain formulations of additive, the coefficient of friction of the commercial car racing oil (Ashland, produced by Ashland, Inc.) is further reduced by approximately 35% (sample 900-1) and wear spot is further reduced by approximately 15% (sample 897).

As can be seen from Table XI, at certain formulations of the additive, the coefficient of friction of the commercial mineral oil, SAE:15W40 API: CF/CC, is further reduced by approximately 43% (sample 941) and wear spot is further reduced by approximately 17% (sample 940).

In other samples, Semi Synthetic SAE:5W30 API: CL oil was used which has very good tribological characteristics, as shown in Table XI. At certain formulations of the additive, wear spot is further reduced by approximately 3.3% (sample 949). Reduction of friction coefficient was observed at 1000 rpm by approximately 13% (sample 948) and at 1500 rpm by approximately 21% (sample 954). Certain additive formulations demonstrated better tribological properties than this oil with commercial additive called Ceratec, produced by Ceratec, Alberta, Canada, containing h-BN as a solid lubricant.

Thus experiments of this series demonstrate that certain formulations of the additives provide from modest to significant improvements of the tribological properties of the commercial lubricating oils depending on the initial formulated oil properties, with the worse the initial properties, the better the improvement after addition of the additives.

Experiment XII

In this series of experiments, real life tests on influence of the additives mixed with motor oil on gasoline consumption were performed. In a first test, MPG Toyota Test, a 2003 Toyota Celica was used. Before oil change, the 2003 Toyota Celica had an average gasoline consumption of 29.5 miles per gallon (mpg). After oil change (5W30 Exxon Mobile Superflow oil was used), 200 ml of PAO-based additive was added to 4 quarts of the motor oil, resulting in approximately 0.025 wt. % of 20 nm DND, 1.5 wt. % of D1.11 and 0.5 wt. % of Molyvan-L. Following consequent gas fillings gas mileage was calculated to be; 30.6; 30.0; 32.8; 31.2; 31.2 miles per gallon. On average, improvement in fuel consumption efficiency was 5.6% (31.2 mpg).

In a second test, MPG Ford Test, a 2004 Ford Focus was used. Before oil change, the 2004 Ford Focus had average gasoline consumption efficiency of 31.4 miles per gallon. After oil change (10W30 Pennsoil oil was used), 200 ml of PAO-based additive was added to 4 quarts of the motor oil, resulting in approximately 0.025 wt. % of 20 nm DND, 1.5 wt. % of D1.11 and 0.5 wt. % of Molyvan-L. During consequent gas fillings gas mileage were; 30.7; 33.2; 33.5 miles per gallon. On average, improvement in oil efficiency was 3.4% (32.5 mpg).

In both tests, MPG Toyota Test and MPG Ford Test, after first and second gas fillings, observed improvement was modest (Toyota) or no improvement was observed (Ford). However, after that gasoline consumption improvements stabilized at a level of approximately 5-7%. In both cars, engines were observed to work more quietly after adding the additives.

In both MPG Toyota Test and MPG Ford Test, all other driving variables, for example, speed, acceleration, incline, and vehicle load, were typical of normal daily use. It was shown in MPG Toyota Test and MPG Ford Test that the lubricant additive prepared as described in Experiment XII can be prepared using, as a base oil, at least one of a mineral oil, a synthetic oil, a semi-synthetic oil, a semi-synthetic severely hydro cracked oil.

In another embodiment, the synthetic oil is polyalphaolefin, wherein said polyalphaolefin has a viscosity from 2 to 460 centistokes at 100° C. In another embodiment said polyalphaolefin has a viscosity of from 2 to 10 centistokes at 100° C. Yet in another embodiment said polyalphaolefin has a viscosity of from 4 to 6 centistokes at 100° C. Yet in another embodiments oils from other classes can have viscosities in similar ranges.

Thus experiments I-XII above demonstrate that preparations of a base oil and other additives such as:

(i) DND with fluorine-containing dispersants, (ii) DND with fluorine-containing dispersants and F-ZDDP·nR—$NH_2$, (iii) DND with fluorine-containing dispersants and F-ZDDP·nR—$NH_2$, and other AW/EP additives such as, for example, Molyvan L, Molyvan 807, Molyvan 2000, (iv) DND with fluorine-containing dispersants and other AW/EP additive components such as, for example, $MoS_2$, h-BN, (v) DND with fluorine-containing dispersants and PTFE, where PTFE can be produced by different methods, (vi) DND with fluorine-containing dispersants or other types of dispersants and AW/EP additive components, (vii) DND and AW/EP additive components, at certain compositions, the preparations can significantly improve tribological characteristics of a base oil. Examples with formulations of OLC and detonation soot dispersed in PAO oil using fluorine-containing additives resulting in improved tribological characteristics were also demonstrated. Surprising were highly increased EP failure load of PAO-based oils with additives at certain compositions of the preparations. Depending on the formulations, the coefficient of friction or/and diameter of the wear spot can be also improved (decreased). Importantly, EP failure load of low viscosity oil such as PAO-2 can be also increased using the above preparations. Low viscosity oils are important for engines with high rpm. Low viscosity oils typically possess unique low temperature properties and contribute to efficient fuel use.

From the experiments reported above it is clear that a wide variety of combinations of synergistic additives is possible, aimed at improving a particular tribological property or a combination of properties. Also, depending on the application and characteristics of the friction surfaces (roughness, hardness, material, composition, etc) a combination of additives can be created providing best tribological properties for a specific set of these characteristic.

At small size fractions (below 100 nm), oils preserved their transparency and acquired characteristic amber color that can be advantageous at certain applications. Since nanodiamonds can be made photoluminescent, this property can be also imparted to the oil, providing a unique identification feature.

Thus the above formulations, in addition to typical lubricant applications, can be used in heavy-load applications. The above formulations can be utilized to improve reliability of a heavily loaded gear, such as that used in mining, port facilities and industrial cranes, e.g. in high-torque transmissions; in bearings, various hinges, guides and slides; in vehicles, airplanes, ships, for lubrication of moving parts in suspension and steering, front wheel hubs, universal joints etc.

The experiments above also demonstrate that an additive to a base oil including certain combination of fluorine-containing dispersants and F-ZDDP·nR—$NH_2$ can significantly improve the tribological properties of PAO (and possibly other types of oils), especially EP failure load. Adding DND to this composition can further improve the tribological properties of the composition at certain % of the constituents (synergistic effect). Synergistic effect can be achived by using the oil soluble organo-molybdenum compound, and wherein the oil soluble organo-molybdenum compound comprises at least one of the group consisting of a sulfonated oxymolybdenum, dialkyldithiophosphate, and sulfide molybdenum di-thiophosphate and wherein the oil soluble organo-molybdenum compound is present in an amount from 1.0 to 5.0 wt. %.

The experiments above demonstrated that the combination of ND with different types of PTFE, wherein the polytetrafluoroethylene has a particle size ranging from about 0.05 microns to about 0.5 microns, and fluorine-containing dispersants can significantly improve tribological properties of PAO and other types of oils. It was shown that ND with smaller aggregate size provided more significant improvements in the properties (Table II) at certain embodiments.

The experiments above demonstrated that fluorine-containing dispersants are effective for dispersing of nanodiamond and onion-like carbon and detonation soot in PAO (and other types of oils).

NDs intended for the synergistic compositions can be produced by detonation of carbon-containing explosives or a mixture of explosives with other carbon precursor material (for example, soot, graphite, etc) or by other means. In certain embodiments, fractionation of polydispersed ND powder into fractions with more narrow size distribution can be beneficial. In other embodiments, the use of small primary particles (as small as approximately 3-6 nm particles) or larger primary particles (approximately 10-15nm as produced from a mixture of explosives/graphite), as well as aggregates of the primary particles can be used.

The experiments above demonstrated that the combination of OLC with fluorine-containing dispersants or OLC with ND and fluorine-containing dispersants can improve wear properties of PAO (and possibly other types of oils). It was also demonstrated that functionalization of ND with fluorine-containing surface groups can be beneficial. Similar, OLC can be also functionalized with fluorine-containing groups for applications in lubricants.

The nanodiamond and OLC particles can be modified as a result of wet or gas phase chemical reaction(s), or chemical reactions induced photochemically, electrochemically, mechanochemically, annealing, or by means of a plasma, irradiation or sonic energy or modified during the process of nanodiamond synthesis by introducing dopants and defects to obtain diamond nanoparticles with an enhanced antifriction property.

The lubricant additive in certain embodiments is comprised of: from 65.0 wt. % to 94.9 wt. % of the base oil; from 0.1 wt. % to 5.0 wt. % of nanocarbon particles and aggregates thereof; from 5.0 wt. % to 20.0 wt. % of fluorine containing oligomeric dispersant. The base oil can be a synthetic base oil, where the synthetic base oil comprises at least one of polyalphaolefin, diesters, aromatic esters, polyol esters (neopentyl glycol, trimethylolpropane, pentaerythritol esters), polymer esters (Ketjenlube) and complex esters (Priolube) and their mixtures.

The lubricant additive in certain embodiments can be diluted with about 90-99 parts per 100 of a mineral oil, a synthetic oil, a semi-synthetic oil, a semi-synthetic severely hydro cracked oil, or combinations thereof; motor oil typically used in a crankcase of an internal combustion engine; lubricating oil typically used in heavy duty vehicles and mechanisms. The lubricant additive can be diluted with about 90-99 parts per 100 of a of a lubricating oil, providing a decrease of the coefficient of friction by at least approximately 10%, when compared with the coefficient of friction of the lubricating oil without the additive. The lubricant additive can be diluted with about 90-99 parts per 100 of a of a lubricating oil, providing a decrease of a wear scar diameter as measured by four ball wear test technique by at least approximately 5%, when compared with a wear spot of the lubricating oil without the additive.

According to one embodiment, the lubricant additive includes the fluorine containing oligomeric dispersant, which posses the property of an antifriction and antiwear additive, reducing the coefficient of friction and wear of the base oil.

According to another embodiment, the lubricant additive can be prepared using as a base oil at least one of an oil of class I, class II, class III, class IV or class V.

While various embodiments of the present invention have been described above, and although various examples and experiments disclosing various aspects of the present invention have been disclosed, it should be understood that they have been presented by way of example only, and not limitation. It will be understood by those skilled in the art that various changes in form and details may be made therein without departing from the spirit and scope of the invention as defined in the appended claims. Accordingly, the breadth and scope of the present invention should not be limited by any of the above-described exemplary embodiments, but should be defined only in accordance with the following claims and their equivalents.

The invention claimed is:

1. A lubricant additive comprising:

a base oil;

colloidal nanocarbon particles having surface groups, wherein the colloidal nanocarbon particles comprise at least one type of particle selected from the group consisting of nanodiamonds, functionalized nanodiamonds, polycrystalline nanodiamonds, nanodiamonds surrounded by a $sp^2$ carbon shell, carbon onions, and detonation soot; and a fluorine containing oligomeric dispersant that is anchored to and surrounds the nanocarbon particles and that interacts with the surface groups of the nanocarbon particles, wherein the dispersant inhibits agglomeration of the nanocarbon particles, wherein the fluorine containing oligomeric dispersant includes an anchoring group, a lipophilic hydrocarbon group, and a fluorinated oleophobic group;

wherein the fluorine containing oligomeric dispersant comprises at least one of the group consisting of a fluorine-containing monoester of alkylsuccinic acid, isomers of fluorine-containing monoester of alkylsuccinic acid, and a fluorine-containing diester of alkylsuccinic acid;

wherein the fluorine containing oligomeric dispersant has at least one of isomeric structures (IV.A) and (IV.B) shown below:

(IV.A)

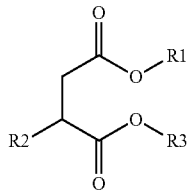

-continued (IV.B)

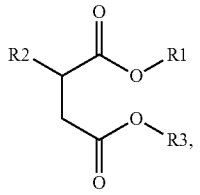

where R2 represents a saturated aliphatic hydrocarbon group, R1 represents a first fluorine containing group, and R3 represents parts of an anchor group or a second fluorine containing group;

wherein the saturated aliphatic hydrocarbon group R2 is polyisobutylene with structure (VI) shown below:

(VI)

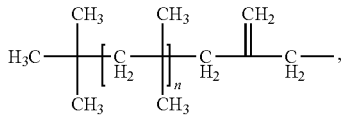

where n=15-60, and where the first fluorine containing group R1 is a fluoroalkyl group or a fluoroalkenyl group; and wherein the first fluorine containing group R1 is a fluorine containing group selected from the group consisting of:

$F_3CCFHCF_2CH_2$—; and $H(CF_2CF_2)_nCH_2$—;

where n=1-10, and where R3=H.

2. The lubricant additive according to claim 1, wherein the base oil comprises at least one oil selected from the group consisting of a mineral oil, a synthetic oil, a semi-synthetic oil, a semi-synthetic severely hydro cracked oil, a vegetable oil, polyalphaolefin, diesters, aromatic esters, polyol esters (neopentyl glycol, trimethylolpropane, pentaerythritol esters), polymer esters, complex esters or mixtures thereof, and a fully formulated oil.

3. The lubricant additive according to claim 1, wherein the nanodiamonds have surfaces and wherein the nanodiamonds are modified by a modification selected from the group consisting of at least one of a wet phase chemical reaction that produces surface modification, gas phase chemical reaction that produces surface modification, a chemical reaction induced photochemically that produces surface modification, a chemical reaction induced electrochemically that produces surface modification, a chemical reaction induced mechanochemically that produces surface modification, annealing that produces surface modification, modification by exposure to a plasma that produces surface modification, exposure to irradiation that produces surface modification, exposure to sonic energy that produces surface modification, and a modification of the nanodiamond carried out during a process of nanodiamond synthesis by introducing dopants or defects, wherein the modification produces nanodiamonds with an enhanced antifriction property.

4. The lubricant additive according to claim 1, wherein the lubricant additive is from 5.0 to 20.0 wt. % fluorine containing oligomeric dispersant.

5. The lubricant additive according to claim 1, wherein the lubricant additive is diluted by about 90-99 parts per 100 with an oil selected from the group consisting of a mineral oil, a synthetic oil, a semi-synthetic oil, a vegetable oil, polyalphaolefin, diesters, aromatic esters, polyol esters (neopentyl glycol, trimethylolpropane, pentaerythritol esters), polymer esters, complex esters or mixtures thereof, a semi-synthetic severely hydro cracked oil, and a fully formulated oil.

6. The lubricant according to claim 1, further comprising at least one component selected from the group consisting of an antifriction component, an antiwear component, an extreme pressure component, zinc dialkyldithiophosphates, polytetrafluoroethylene, an oil soluble organo-molybdenum compound, sulfonated oxymolybdenum, dialkyldithiophosphate, and sulfide molybdenum dithiophosphate.

7. The lubricant additive according to claim 6, wherein the lubricant component is approximately from 1.0 to 10.0 wt. %.

8. A lubricant additive comprising:

a base oil;

colloidal nanocarbon particles having surface groups, wherein the colloidal nanocarbon particles comprise at least one type of particle selected from the group consisting of nanodiamonds, functionalized nanodiamonds, polycrystalline nanodiamonds, nanodiamonds surrounded by a $sp^2$ carbon shell, carbon onions, and detonation soot; and a fluorine containing oligomeric dispersant that is anchored to and surrounds the nanocarbon particles and that interacts with the surface groups of the nanocarbon particles, wherein the dispersant inhibits agglomeration of the nanocarbon particles, wherein the fluorine containing oligomeric dispersant includes an anchoring group, a lipophilic hydrocarbon group, and a fluorinated oleophobic group;

wherein the fluorine containing oligomeric dispersant comprises at least one of the group consisting of a fluorine-containing monoester of alkylsuccinic acid, isomers of fluorine-containing monoester of alkylsuccinic acid, and a fluorine-containing diester of alkylsuccinic acid;

wherein the fluorine containing oligomeric dispersant has at least one of isomeric structures (IV.A) and (IV.B) shown below:

(IV.A)

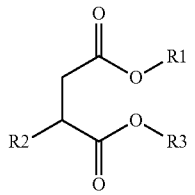

(IV.B)

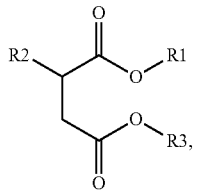

where R2 represents a saturated aliphatic hydrocarbon group, R1 represents a first fluorine containing group, and R3 represents parts of an anchor group or a second fluorine containing group;

wherein the saturated aliphatic hydrocarbon group R2 is polyisobutylene with structure (VI) shown below:

(VI)

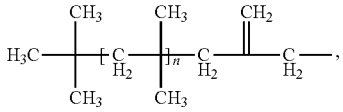

where n=15-60, and where the first fluorine containing group R1 is a fluoroalkyl group or a fluoroalkenyl group; and wherein R1 represents a first fluorine containing group and R3 represents a second fluorine containing group, wherein R1=R3, wherein R1 and R3 are fluorine containing groups of formula $F_3CCFHCF_2CH_2$—; or $H(CF_2CF_2)_nCH_2$—;

where n=1-10.

9. The lubricant additive according to claim 8, wherein the base oil comprises at least one oil selected from the group consisting of a mineral oil, a synthetic oil, a semi-synthetic oil, a semi-synthetic severely hydro cracked oil, a vegetable oil, polyalphaolefin, diesters, aromatic esters, polyol esters (neopentyl glycol, trimethylolpropane, pentaerythritol esters), polymer esters, complex esters or mixtures thereof, and a fully formulated oil.

10. The lubricant additive according to claim 8, wherein the nanodiamonds have surfaces and wherein the nanodiamonds are modified by a modification selected from the group consisting of at least one of a wet phase chemical reaction that produces surface modification, gas phase chemical reaction that produces surface modification, a chemical reaction induced photochemically that produces surface modification, a chemical reaction induced electrochemically that produces surface modification, a chemical reaction induced mechanochemically that produces surface modification, annealing that produces surface modification, modification by exposure to a plasma that produces surface modification, exposure to irradiation that produces surface modification, exposure to sonic energy that produces surface modification, and a modification of the nanodiamond carried out during a process of nanodiamond synthesis by introducing dopants or defects, wherein the modification produces nanodiamonds with an enhanced antifriction property.

11. The lubricant additive according to claim 8, wherein the lubricant additive is from 5.0 to 20.0 wt. % fluorine containing oligomeric dispersant.

12. The lubricant additive according to claim 8, wherein the lubricant additive is diluted by about 90-99 parts per 100 with an oil selected from the group consisting of a mineral oil, a synthetic oil, a semi-synthetic oil, a vegetable oil, polyalphaolefin, diesters, aromatic esters, polyol esters (neopentyl glycol, trimethylolpropane, pentaerythritol esters), polymer esters, complex esters or mixtures thereof, a semi-synthetic severely hydro cracked oil, and a fully formulated oil.

13. The lubricant according to claim 8, further comprising at least one component selected from the group consisting of an antifriction component, an antiwear component, an extreme pressure component, zinc dialkyldithiophosphate, polytetrafluoroethylene, an oil soluble organo-molybdenum compound, sulfonated oxymolybdenum, dialkyldithiophosphate, and sulfide molybdenum dithiophosphate.

14. The lubricant additive according to claim 13, wherein the lubricant component is approximately from 1.0 to 10.0 wt. %.

15. A lubricant additive comprising:

a base oil;

colloidal nanocarbon particles having surface groups, wherein the colloidal nanocarbon particles comprise at least one type of particle selected from the group consisting of nanodiamonds, functionalized nanodiamonds, polycrystalline nanodiamonds, nanodiamonds surrounded by a $sp^2$ carbon shell, carbon onions, and detonation soot; and a fluorine containing oligomeric dispersant that is anchored to and surrounds the nanocarbon particles and that interacts with the surface groups of the nanocarbon particles, wherein the dispersant inhibits agglomeration of the nanocarbon particles, wherein the fluorine containing oligomeric dispersant includes an anchoring group, a lipophilic hydrocarbon group, and a fluorinated oleophobic group;

wherein the fluorine containing oligomeric dispersant comprises at least one of the group consisting of a fluorine-containing monoester of alkylsuccinic acid, isomers of fluorine-containing monoester of alkylsuccinic acid, and a fluorine-containing diester of alkylsuccinic acid; and wherein the fluorine containing oligomeric dispersant is obtained by a reaction involving monoester of alkylsuccinic acid, diester of alkyl-succinic acid, or alkenylsuccinic acid and at least one polyfluorinated alcohol selected from the group consisting of:

$H(CF_2CF_2)_nCH_2OH$: where n=2-6; and $F_3CCFHCF_2CH_2OH$.

16. The lubricant additive according to claim 15, wherein the base oil comprises at least one oil selected from the group consisting of a mineral oil, a synthetic oil, a semi-synthetic oil, a semi-synthetic severely hydro cracked oil, a vegetable oil, polyalphaolefin, diesters, aromatic esters, polyol esters (neopentyl glycol, trimethylolpropane, pentaerythritol esters), polymer esters, complex esters or mixtures thereof, and a fully formulated oil.

17. The lubricant additive according to claim 15, wherein the nanodiamonds have surfaces and wherein the nanodiamonds are modified by a modification selected from the group consisting of at least one of a wet phase chemical reaction that produces surface modification, gas phase chemical reaction that produces surface modification, a chemical reaction induced photochemically that produces surface modification, a chemical reaction induced electrochemically that produces surface modification, a chemical reaction induced mechanochemically that produces surface modification, annealing that produces surface modification, modification by exposure to a plasma that produces surface modification, exposure to irradiation that produces surface modification, exposure to sonic energy that produces surface modification, and a modification of the nanodiamond carried out during a process of nanodiamond synthesis by introducing dopants or defects, wherein the modification produces nanodiamonds with an enhanced antifriction property.

18. The lubricant additive according to claim 15, wherein the lubricant additive is from 5.0 to 20.0 wt. % fluorine containing oligomeric dispersant.

19. The lubricant additive according to claim 15, wherein the lubricant additive is diluted by about 90-99 parts per 100 with an oil selected from the group consisting of a mineral oil, a synthetic oil, a semi-synthetic oil, a vegetable oil, polyalphaolefin, diesters, aromatic esters, polyol esters (neopentyl glycol, trimethylolpropane, pentaerythritol esters), polymer esters, complex esters or mixtures thereof, a semi-synthetic severely hydro cracked oil, and a fully formulated oil.

20. The lubricant according to claim 15, further comprising at least one component selected from the group consisting of an antifriction component, an antiwear component, an extreme pressure component, zinc dialkyldithiophosphate, polytetrafluoroethylene, an oil soluble organo-molybdenum compound, sulfonated oxymolybdenum, dialkyldithiophosphate, and sulfide molybdenum dithiophosphate.

21. The lubricant additive according to claim 20, wherein the lubricant component is approximately from 1.0 to 10.0 wt. %.

22. The lubricant additive according to claim 15, wherein the nanodiamond particles are photoluminescent, imparting photoluminescence to the oil to identify the mixture of the nanodiamond particles in the oil.

23. The lubricant additive according to claim 15, wherein the nanodiamond particles are photoluminescent, imparting photoluminescence to the oil to uniquely identify the mixture of the nanodiamond particles in the oil.

24. The lubricant additive according to the claim 15, wherein the anchoring group includes at least one selected from the group consisting of carboxylic acid groups, ketones, hydroxyl groups, fluorine, hydrogen, amine, silane, acrylic groups, aliphatic chains and esters.

25. The lubricant additive according to the claim 15, wherein the lubricant additive is utilized to improve reliability of heavily loaded gears, high-torque transmissions, bearings, hinges, guides, slides, vehicles, airplanes, ships, for lubrication of moving parts in suspension and steering, front wheel hubs, universal joints.

* * * * *